US011213870B2

(12) United States Patent
Shafiei et al.

(10) Patent No.: US 11,213,870 B2
(45) Date of Patent: Jan. 4, 2022

(54) MICRO-TEXTURED SURFACES VIA LOW PRESSURE ROLLING

(71) Applicant: Novelis Inc., Atlanta, GA (US)

(72) Inventors: Mehdi Shafiei, Farmington Hills, MI (US); John A. Hunter, Kingston (CA); Peter Knelsen, Roswell, GA (US); Steven L. Mick, Fairmont, WV (US)

(73) Assignee: NOVELIS INC., Atlanta, GA (US)

( * ) Notice: Subject to any disclaimer, the term of this patent is extended or adjusted under 35 U.S.C. 154(b) by 283 days.

(21) Appl. No.: 16/041,254

(22) Filed: Jul. 20, 2018

(65) Prior Publication Data

US 2019/0022720 A1 Jan. 24, 2019

Related U.S. Application Data

(60) Provisional application No. 62/535,345, filed on Jul. 21, 2017, provisional application No. 62/535,341,
(Continued)

(51) Int. Cl.
*B21B 37/28* (2006.01)
*B21B 1/22* (2006.01)
(Continued)

(52) U.S. Cl.
CPC ..... *B21B 1/227* (2013.01); *B21B 31/20* (2013.01); *B21B 37/28* (2013.01); *B21B 37/30* (2013.01);
(Continued)

(58) Field of Classification Search
CPC ..... B21B 1/22; B21B 2001/221; B21B 1/227; B21B 2001/228; B21B 1/28;
(Continued)

(56) References Cited

U.S. PATENT DOCUMENTS 1,106,172 A 8/1914 Wetcke
3,619,881 A * 11/1971 Bills ..... B21B 1/227 492/1
(Continued)

FOREIGN PATENT DOCUMENTS

CN 1230475 A 10/1999
CN 201033332 Y 3/2008
(Continued)

OTHER PUBLICATIONS

Translation; JP 2012-52290 A, Fukatsu et al. Mar. 2012.*
(Continued)

*Primary Examiner* — Edward T Tolan
(74) *Attorney, Agent, or Firm* — Kilpatrick Townsend & Stockton LLP

(57) ABSTRACT

A substrate (e.g., metal or non-metal sheet) can have multiple textures on a surface of the substrate. The various textures can be impressed or applied on the surface of the substrate by passing the substrate between multiple pairs of work rolls that each include at least one textured work roll for transferring a texture of the work roll onto the surface of the substrate. The pairs of work rolls apply the various textures on the surface of the substrate while maintaining a thickness of the substrate (e.g., with substantially no reduction in a thickness of the substrate). A single pass of the substrate between the pairs of work rolls can allow various different textures, patterns, or features to be applied to the surface of the substrate while the thickness of the substrate remains substantially constant.

16 Claims, 11 Drawing Sheets

Related U.S. Application Data filed on Jul. 21, 2017, provisional application No. 62/535,349, filed on Jul. 21, 2017, provisional application No. 62/551,296, filed on Aug. 29, 2017, provisional application No. 62/551,292, filed on Aug. 29, 2017, provisional application No. 62/551,298, filed on Aug. 29, 2017.

(51) Int. Cl.

| | |
|---|---|
| ***B21B 37/30*** | (2006.01) |
| ***B21B 31/20*** | (2006.01) |
| *B21B 38/00* | (2006.01) |
| *B21B 37/58* | (2006.01) |
| *B21B 13/14* | (2006.01) |
| *B21B 3/00* | (2006.01) |
| *B21B 29/00* | (2006.01) |
| *B21H 8/00* | (2006.01) |

(52) U.S. Cl.

CPC ..... *B21B 13/14* (2013.01); *B21B 13/147* (2013.01); *B21B 29/00* (2013.01); *B21B 37/58* (2013.01); *B21B 38/00* (2013.01); *B21B 2001/228* (2013.01); *B21B 2003/001* (2013.01); *B21B 2261/14* (2013.01); *B21B 2265/12* (2013.01); *B21B 2267/10* (2013.01); *B21H 8/005* (2013.01)

(58) Field of Classification Search

CPC ..... B21B 2261/14; B21B 27/005; B21B 2013/025; B21B 2013/028; B21B 13/14; B21B 13/145; B21B 13/147; B21B 31/20; B21B 31/18; B21B 37/28; B21B 37/30; B21H 8/005

See application file for complete search history.

(56) References Cited

U.S. PATENT DOCUMENTS

| | | | | | |
|---|---|---|---|---|---|
| 4,017,367 | A | | 4/1977 | Saunders | |
| 4,978,583 | A | * | 12/1990 | Wakui | B21B 1/227 428/600 |
| 5,025,547 | A | * | 6/1991 | Sheu | B21B 1/227 29/527.4 |
| 5,508,119 | A | * | 4/1996 | Sheu | B21B 1/227 219/121.67 |
| 5,666,844 | A | * | 9/1997 | Bieber | B21B 13/147 72/238 |
| 5,904,204 | A | | 5/1999 | Teraoka et al. | |
| 6,868,707 | B2 | * | 3/2005 | Nishi | B21B 37/40 72/11.9 |
| 7,353,681 | B2 | | 4/2008 | Ball et al. | |
| 7,516,637 | B2 | | 4/2009 | Scamans et al. | |
| 7,624,609 | B2 | | 12/2009 | Ball et al. | |
| 2003/0150587 | A1 | | 8/2003 | Li et al. | |
| 2005/0115295 | A1 | * | 6/2005 | Pont | B21B 1/227 72/252.5 |
| 2006/0123867 | A1 | | 6/2006 | Ball et al. | |
| 2009/0004044 | A1 | | 1/2009 | Sawada et al. | |
| 2010/0242559 | A1 | * | 9/2010 | Saenz de Miera | B21B 1/38 72/207 |
| 2012/0298183 | A1 | | 11/2012 | Buresch et al. | |
| 2013/0273394 | A1 | * | 10/2013 | Sheu | B21B 28/02 428/687 |
| 2016/0052032 | A1 | | 2/2016 | Moden | |
| 2016/0059283 | A1 | * | 3/2016 | Breuer | B21B 37/28 72/19.6 |
| 2019/0022721 | A1 | | 1/2019 | Shafiei et al. | |
| 2019/0022724 | A1 | | 1/2019 | Shafiei et al. | |

FOREIGN PATENT DOCUMENTS

| | | | | | |
|---|---|---|---|---|---|
| CN | 101288880 | A | | 10/2008 | |
| CN | 202984272 | U | | 6/2013 | |
| CN | 103949481 | A | | 7/2014 | |
| CN | 104785541 | A | | 7/2015 | |
| CN | 104870111 | A | | 8/2015 | |
| CN | 106903170 | A | | 6/2017 | |
| DE | 102007028823 | | | 12/2008 | |
| EP | 1607150 | | | 12/2005 | |
| EP | 1297903 | | | 8/2006 | |
| EP | 1368140 | | | 8/2006 | |
| EP | 2292341 | | | 3/2011 | |
| EP | 2670540 | | | 2/2016 | |
| GB | 10850 | A | | 7/1914 | |
| JP | 62-86120 | A | * | 4/1987 | B21B 13/147 |
| JP | H03114601 | A | | 5/1991 | |
| JP | 3-169403 | A | * | 7/1991 | B21B 1/227 |
| JP | 03-238108 | A | * | 10/1991 | B21B 1/22 |
| JP | H06171261 | A | | 6/1994 | |
| JP | 7-51701 | A | * | 2/1995 | B21B 1/227 |
| JP | H09225555 | A | | 9/1997 | |
| JP | H10501470 | A | | 2/1998 | |
| JP | 2006239744 | A | | 9/2006 | |
| JP | 2007516841 | A | | 6/2007 | |
| JP | 2010260074 | A | | 11/2010 | |
| JP | 2012052290 | A | | 3/2012 | |
| JP | 2012157899 | A | | 8/2012 | |
| JP | 2012206170 | A | | 10/2012 | |
| JP | 2013094820 | A | | 5/2013 | |
| JP | 2015182107 | A | | 10/2015 | |
| RU | 2158639 | C2 | | 11/2000 | |
| RU | 2333811 | C2 | | 9/2008 | |
| SU | 100256 | A | | 11/1954 | |
| SU | 931244 | A1 | | 5/1982 | |
| SU | 1447447 | A1 | | 12/1988 | |
| WO | 2006002784 | | | 1/2006 | |
| WO | 2016034658 | A1 | | 3/2016 | |

OTHER PUBLICATIONS

PCT/US2018/043045 , "International Search Report and Written Opinion", dated Oct. 16, 2018, 14 pages.

Suzuki et al., "Strip Shape Control System of Mitsubishi CR Mill", Conference Record of the IEEE Industry Applications Conference. 34th IAS Annual Meeting. Phoenix, AZ, Oct. 3, 1999, pp. 565-570.

PCT/US2018/043045 , "International Preliminary Report on Patentability", dated Jan. 30, 2020, 10 pages.

Russian Patent Application No. 2020102498 , Office Action dated Nov. 2, 2020, 10 pages.

Chinese Patent Application No. 201880048614.3 , Office Action dated Nov. 26, 2020, 18 pages.

Indian Patent Application No. 202017001919 , First Examination Report dated Dec. 2, 2020, 5 pages.

Japanese Patent Application No. 2020-523240 , Office Action dated Dec. 15, 2020, 7 pages.

Canadian Patent Application No. 3,069,979 , Office Action, dated Apr. 12, 2021, 7 pages.

Japanese Patent Application No. 2020-523240 , Office Action, dated Apr. 6, 2021, 7 pages.

Korean Patent Application No. 10-2020-7004644 , Office Action, dated Mar. 18, 2021, 13 pages.

Japanese Application No. 2020-523240, Notice of Allowance, dated Jul. 6, 2021, 3 pages.

Australian Application No. 2018302332, Notice of Acceptance, dated Aug. 10, 2021, 3 pages.

Chinese Application No. 201880048614.3, Office Action, dated Jul. 8, 2021, 22 pages.

* cited by examiner

MICRO-TEXTURED SURFACES VIA LOW PRESSURE ROLLING

REFERENCE TO RELATED APPLICATIONS

This application claims the benefit of U.S. Provisional Application No. 62/535,345, filed on Jul. 21, 2017 and entitled SYSTEMS AND METHODS FOR CONTROLLING SURFACE TEXTURING OF A METAL SUBSTRATE WITH LOW PRESSURE ROLLING; U.S. Provisional Application No. 62/535,341, filed on Jul. 21, 2017 and entitled MICRO-TEXTURED SURFACES VIA LOW PRESSURE ROLLING; U.S. Provisional Application No. 62/535,349, filed on Jul. 21, 2017 and entitled SYSTEMS AND METHODS FOR CONTROLLING FLATNESS OF A METAL SUBSTRATE WITH LOW PRESSURE ROLLING; U.S. Provisional Application No. 62/551,296, filed on Aug. 29, 2017 and entitled SYSTEMS AND METHODS FOR CONTROLLING SURFACE TEXTURING OF A METAL SUBSTRATE WITH LOW PRESSURE ROLLING; U.S. Provisional Application No. 62/551,292, filed on Aug. 29, 2017 and entitled MICRO-TEXTURED SURFACES VIA LOW PRESSURE ROLLING; and U.S. Provisional Application No. 62/551,298, filed on Aug. 29, 2017 and entitled SYSTEMS AND METHODS FOR CONTROLLING FLATNESS OF A METAL SUBSTRATE WITH LOW PRESSURE ROLLING, all of which are hereby incorporated by reference in their entireties.

FIELD OF THE INVENTION

This disclosure generally relates to texturing metal or alloy sheets. More specifically, but not by way of limitation, this disclosure relates to an aluminum or aluminum alloy sheet having multiple textures on a surface of the aluminum or aluminum alloy sheet.

BACKGROUND

Metal rolling can be used for forming metal strips from stock, such as ingots or thicker metal strips. Metal rolling involves passing a metal strip or substrate (e.g., aluminum or other metallic material) between a pair of work rolls of a mill stand, which apply a load or force to the metal strip. A texture of the surface of the work rolls can be an important factor of metal rolling operations. For example, the force applied by the work rolls can cause a texture of the work rolls to be transferred onto a surface of the metal strip as the metal strip passes between the work rolls. However, the force applied to the metal strip by the work rolls during metal rolling operations can also reduce the thickness of the metal strip.

SUMMARY

The term embodiment and the like terms are intended to refer broadly to all the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim.

Certain aspects and features of the present disclosure relate to a substrate having multiple micro-textures, features, or patterns on a surface of the substrate. In some examples, the substrate may be a metal substrate (e.g., a metal sheet or a metal alloy sheet) or a non-metal substrate. For example, the substrate may include aluminum, aluminum alloys, steel, steel-based materials, magnesium, magnesium-based materials, copper, copper-based materials, composites, sheets used in composites, or any other suitable metal, non-metal, or combination of materials.

In some aspects, the substrate is a metal substrate. Although the following description is provided with reference to the metal substrate, it will be appreciated that the description is applicable to various other types of metal or non-metal substrates. The metal substrate can have at least a first feature and a second feature on the surface of the metal substrate. In some examples, a work stand includes various pairs of work rolls (e.g., cold mill work rolls or hot mill work rolls) having different textures. Each pair of work rolls includes an upper work roll and a lower work roll vertically aligned with the upper work roll. The upper work roll and lower work roll are supported by intermediate rolls. Bearings (also referred to as actuators) are provided along the intermediate rolls and are configured to impart bearing loads on the intermediate rolls. In this example, at least one of the upper work roll and the lower work roll includes a texture.

During the texturing process, a metal substrate can pass between the upper and lower work rolls and the upper and lower work rolls apply a work roll pressure to the metal substrate as the metal substrate passes between the work rolls. To prevent the thickness of the metal substrate from being reduced (e.g., the thickness of the metal substrate remains substantially constant and there is substantially no reduction in the thickness of the metal substrate), the bearings are configured to impart bearing loads on the intermediate rolls. The intermediate rolls then transfer the load to the work rolls such that the work rolls impart a work roll pressure on the metal substrate that is below the yield strength of the metal substrate as the metal substrate passes between the work rolls. The yield strength of a substrate refers to an amount of stress or pressure at which plastic deformation (i.e., permanent deformation) occurs through a portion of the thickness or gauge of the substrate (e.g., an amount of stress or pressure that can cause a permanent change in a substantial portion of the thickness or gauge of the metal substrate). Because the work roll pressure imparted by the work rolls on the metal substrate generates a pressure that is below the yield strength of the metal substrate, the thickness of the metal substrate remains substantially constant (e.g., there is substantially no reduction in the thickness of the metal substrate).

In some examples, while the work roll pressure applied by each of the work rolls is below the yield strength of the metal substrate, a texture on the work rolls may have a topography that creates localized areas on the surface of the metal substrate where the localized pressure is above the yield strength of the metal substrate as the metal substrate passes between the work rolls. These localized areas may form various asperities or skewed areas, which are projections or indentations on the surface of the metal substrate of any suitable height, depth, shape, or size depending on a desired application or use of the metal substrate. In other words, the work rolls can generate localized pressure at asperity contacts that may be high enough to overcome the yield strength of the metal substrate in these localized areas. At these localized areas, because the pressure created by the texture on the work rolls is greater than the yield strength of the metal substrate, localized areas of plastic deformation form on the surface of the metal substrate that create various surface textures, features, or patterns on the surface of the metal substrate while leaving the remainder of the surface un-deformed (e.g., the texture causes plastic deformation at a particular location on the surface of the metal substrate while the thickness of the metal substrate remains substantially constant along the metal substrate). In some examples, the localized pressure created by the texture at the localized areas is greater than the yield strength such that various textures, features, or patterns can be impressed on the surface, but the work roll pressure is not sufficient to cause a substantial reduction in a thickness of the metal substrate at the localized areas (e.g., the texture causes plastic deformation at particular locations on the surface of the metal substrate while the thickness of the metal substrate remains substantially constant along the remainder of the metal substrate). As an example, the localized pressure created by the texture at the localized areas is greater than the yield strength of the metal substrate such that various textures, features, or patterns can be impressed on the surface, but does not cause a substantial reduction in a thickness of the metal substrate across a width or along a length of the metal substrate. As an example, the pressure can cause less than a 1% reduction in the thickness of the metal substrate across the width or along a length of the metal substrate. Thus, in some examples, work rolls can be used to cause localized areas of plastic deformation on the surface of the metal substrate (i.e. to transfer the texture from the work rolls to the surface of the metal substrate) without changing the overall thickness of the metal substrate.

In some examples, multiple work rolls can be used to cause localized areas of plastic deformation on the surface of the metal substrate to transfer textures from the work rolls to the surface of the metal substrate without changing the overall thickness of the metal substrate. In this example, the multiple work rolls can impress various textures, features, or patterns on the surface of the metal substrate without reducing the overall thickness of the metal substrate. In additional or alternative examples, the multiple work rolls can impress the various textures, features, or patterns on the surface of the metal substrate while maintaining the thickness of the metal substrate (e.g., the multiple work rolls may not reduce the thickness of the metal substrate while impressing the textures, features, or patterns), which can sometimes be referred to as zero cold reduction texturing.

As one example, the metal substrate can be an aluminum sheet or an aluminum alloy sheet. The metal substrate can be passed between a first pair of work rolls of a mill stand. The first pair of work rolls can apply a first work roll pressure on the metal substrate that is below the yield strength of the metal substrate as the metal substrate passes between the pair of work rolls. The first work roll pressure can be based on a fixed or predetermined amount of force that generates a work roll pressure that is below the yield strength of the metal substrate such that an overall thickness of the metal substrate remains substantially constant across its width and length. At least one work roll of the first pair of work rolls has a surface texture or topography that creates localized areas on the surface of the metal substrate where a pressure at the localized areas is above the yield strength of the metal substrate to fully or partially transfer the texture onto the surface of the metal substrate as the metal substrate passes between the first pair of work rolls. Subsequently, the metal substrate can be passed between a second pair of work rolls, which can include at least a work roll that has another, different texture that can be transferred onto the surface of the metal substrate as the second pair of work rolls imparts a second work roll pressure that is below the yield strength of the metal substrate as the metal substrate passes through the second pair of work rolls. In this example, at least one work roll of the second pair of work rolls has a surface texture or topography that creates localized areas on the surface of the metal substrate where a pressure at the localized areas is above the yield strength of the metal substrate to fully or partially transfer the different texture onto the surface of the metal substrate as the metal substrate passes between the second pair of work rolls. In an additional or alternative example, the second pair of work rolls can include at least a work roll that has a texture similar to the work roll of the first pair of work rolls and the texture or topography of the work roll creates localized areas on the surface of the metal substrate where a pressure at the localized areas is above the yield strength of the metal substrate to fully or partially transfer the same texture onto the surface of the metal substrate as the metal substrate passes between the second pair of work rolls.

In some examples, as described above, the first pair of work rolls can transfer a first texture onto the surface of the metal substrate as the metal substrate passes between the first pair of work rolls and the second pair of work rolls can transfer a second, different texture onto the surface of the metal substrate as the metal substrate passes between the second pair of work rolls. As an example, the first texture applied by the first pair of work rolls can have a size, depth, height, shape, coarseness, and/or concentration that is different from a size, depth, height, shape, coarseness, and/or concentration of the second texture. In this manner, various textures, features, or patterns can be applied on the surface of the metal substrate in a single pass of the metal substrate between multiple pairs of work rolls. In some cases, the metal substrate makes multiple passes between the multiple pairs of work rolls.

In various examples, the first pair of work rolls can include a work roll that has a relatively smooth outer surface such that the first pair of work rolls can provide a desired flatness profile (e.g., substantially flat, curved, wavy, etc.) on the metal substrate and can smooth the topography of the metal substrate (e.g., to have a surface roughness lower than about 0.4-0.6 μm). In this example, the second pair of work rolls can include a work roll that has a textured surface such that the second pair of work rolls can impress a texture, feature, or pattern on the surface of the metal substrate without reducing the overall thickness of the metal substrate.

In some examples, as described above, the work roll pressure imparted on the metal substrate by each pair of work rolls is a low amount of pressure below the yield strength of the metal substrate such that the thickness of the metal substrate remains substantially constant (e.g., there is substantially no reduction in the thickness of the metal substrate) as the metal substrate passes between the pairs of work rolls while the surface texture on each pair of work rolls may have a topography that creates localized areas on the surface of the metal substrate where the pressure is above the yield strength of the metal substrate as the metal substrate passes between the work rolls. In this example, because the work roll pressure imparted by the work rolls is below the yield strength of the metal substrate and the texture of the work rolls causes localized plastic deformation at particular areas on the surface of the metal substrate, the metal substrate is only deformed at the particular areas on the surface of the metal substrate corresponding to the texture of the work rolls, while the thickness of the metal substrate remains constant. In this manner, work rolls can be used to cause localized plastic deformation on the surface of the metal substrate without changing the overall thickness of the metal substrate.

In some examples, impressing different textures, patterns, or features on the surface of the metal substrate can cause the metal substrate to have enhanced characteristics, including, for example, increased lubricant retention, increased de-stacking capabilities, increased resistance spot weldability, increased adhesion, reduced galling, enhanced optical properties, frictional uniformity, etc.

These advantages, among others, may allow the metal substrate, often in the form of metal sheet or plate, to be further processed into automotive parts, beverage cans and bottles and/or any other highly-formed metal product with greater ease and efficiency. For example, the improved tribological characteristics of the metal substrate having a surface with various textures described herein may allow for faster and more stable processing of high-volume automotive products because the friction characteristics of the textured metal substrate being formed are more consistent and isotropic between different batches of material and/or along the same strip of metal substrate. In addition, introducing negatively skewed surface textures (e.g., micro-dimples on the surface of the metal substrate) could help disrupt the surface tension between lubed metal substrates that are stacked together, thus improving de-stacking capability. Furthermore, the improved ability for the surface of the metal substrate to retain lubricant may further reduce and/or stabilize frictional forces between the forming die and the sheet metal surfaces, leading to better formability with reduced earing, wrinkling and tear-off rates; higher processing speeds; reduced galling, enhanced tool life and improved surface quality in the formed parts.

BRIEF DESCRIPTION OF THE DRAWINGS

Illustrative examples of the present disclosure are described in detail below with reference to the following drawing figures.

DETAILED DESCRIPTION

Figure 1:
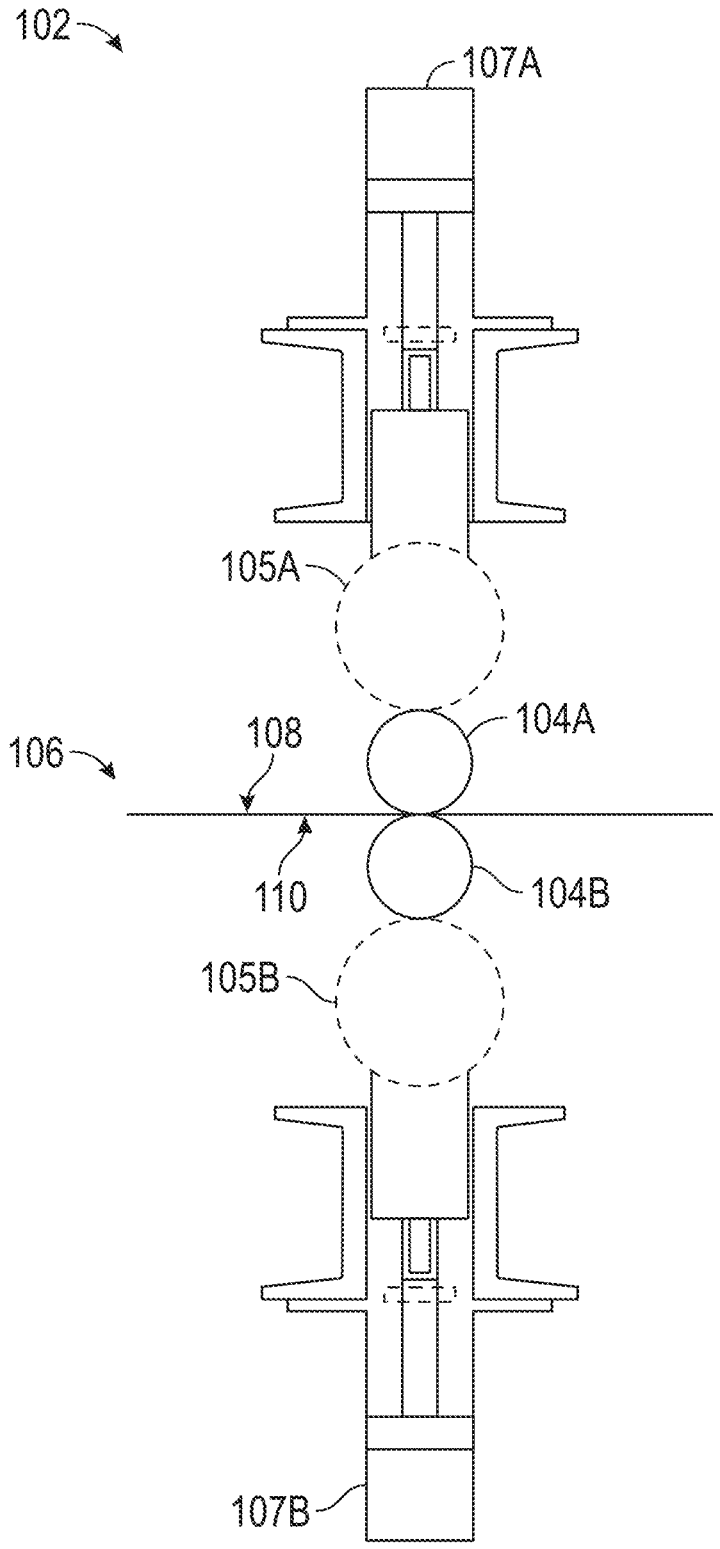
FIG. 1 is a schematic cross-sectional view of an exemplary mill stand that includes a pair of work rolls for applying a texture on a surface of a metal substrate, according to one example of the present disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described Certain aspects and features of the present disclosure relate to a substrate having multiple micro-textures, features, or patterns on a surface of the substrate. In some examples, the substrate may be a metal substrate (e.g., a metal sheet or a metal allow sheet) or a non-metal substrate. For example, the substrate may include aluminum, aluminum alloys, steel, steel-based materials, magnesium, magnesium-based materials, copper, copper-based materials, composites, sheets used in composites, or any other suitable metal, non-metal, or combination of materials.

In some aspects, the substrate is a metal substrate. Although the following description is provided with reference to the metal substrate, it will be appreciated that the description is applicable to various other types of metal or non-metal substrates. For example, a metal substrate has at least a first texture and a second texture on a surface of the metal substrate. In some examples, the first texture or feature is applied to the surface of the metal substrate by passing the metal substrate between a first pair of work rolls. The first pair of work rolls apply a first work roll pressure to the metal substrate as the metal substrate passes between the work rolls. To prevent the thickness of the metal substrate from being reduced (e.g., the thickness of the metal substrate remains substantially constant and there is substantially no reduction in the thickness of the metal substrate), the first pair if work rolls impart a first work roll pressure on the metal substrate that is below the yield strength of the metal substrate as the metal substrate passes between the work rolls. The yield strength of a substrate refers to an amount of stress or pressure at which plastic deformation (i.e., permanent deformation) occurs through a portion of the thickness or gauge of the substrate (e.g., an amount of stress or pressure that can cause a permanent change in a substantial portion of the thickness or gauge of the metal substrate). Because the first work roll pressure imparted by the first pair of work rolls on the metal substrate is below the yield strength of the metal substrate, the thickness of the metal substrate remains substantially constant (e.g., there is substantially no reduction in the thickness of the metal substrate).

In this example, at least one work roll in the first pair of work rolls has the first texture. While the first work roll pressure applied by the first pair of work rolls is below the yield strength of the metal substrate, the first texture on the work roll may have a topography that creates localized areas on the surface of the metal substrate where the localized pressure is above the yield strength of the metal substrate as the metal substrate passes between the first pair of work rolls. These localized areas may form various asperities or skews, which are projections or indentations on the surface of the metal substrate of any suitable height, depth, shape, or size depending on a desired application or use of the metal substrate. In other words, the first pair of work rolls can generate localized pressure at asperity contacts that may be high enough to overcome the yield strength of the metal substrate in these localized areas. At these localized areas, because the pressure created by the first texture on the work roll is greater than the yield strength of the metal substrate, localized areas of plastic deformation form on the surface of the metal substrate that impart the first texture on the surface of the metal substrate while leaving the remainder of the surface un-deformed (e.g., the first texture causes plastic deformation at a particular location on the surface of the metal substrate while the thickness of the metal substrate remains substantially constant along the metal substrate). In some examples, the localized pressure created by the first texture at the localized areas is greater than the yield strength such that various textures, features, or patterns can be impressed on the surface, but the first work roll pressure is not sufficient to cause a substantial reduction in a thickness of the metal substrate at the localized areas (e.g., the first texture causes plastic deformation at particular locations on the surface of the metal substrate while the thickness of the metal substrate remains substantially constant along the remainder of the metal substrate). As an example, the localized pressure created by the first texture at the localized areas is greater than the yield strength of the metal substrate such that the first texture can be impressed on the surface of the metal substrate, but does not cause a substantial reduction in a thickness of the metal substrate across a width or along a length of the metal substrate. As an example, the localized pressure caused by the first texture can cause less than a 1% reduction in the thickness of the metal substrate across the width or along a length of the metal substrate.

In some examples, the second texture or feature is applied to the surface of the metal substrate by passing the metal substrate between a second pair of work rolls after the metal substrate has passed between the first pair of work rolls. The second pair of work rolls includes at least one work roll having the second texture and the second pair of work rolls applies a second work roll pressure on the metal substrate as the metal substrate passes between the work rolls. The second work roll pressure applied by the second pair of work rolls can be below the yield strength of the metal substrate. In this example, the second work roll pressure that is below the yield strength of the metal substrate, along with a topography of the second texture on the work roll can create second areas or locations on the surface of the metal substrate where the localized pressure on the surface of the metal substrate at the second areas or locations is greater than the yield strength of the metal substrate. In this example, because the localized pressure at the second areas or locations on the surface of the metal substrate is above the yield strength, the work roll can create localized plastic deformation at the second areas or locations on the surface of the metal substrate to transfer the second texture onto the surface of the metal substrate at the second areas or locations as the metal substrate passes between the second pair of work rolls.

In some examples, the first texture transferred to the surface of the metal substrate can be different from the second texture. For example, the first texture can have a size, shape, depth, height, coarseness, and/or concentration that is different from a size, shape, depth, height, coarseness, and/or concentration of the second texture. As an illustrative example, the first texture can cause a portion of the surface of the metal substrate to be a negatively skewed area that can include a valley and the second texture can cause another portion of the surface of the metal substrate to be a positively skewed area that can include an asperity or a peak. In this example, microscopic asperities, peaks and valleys that are included in the textured portions of the surface can be of any shape or size. For example, each asperity, peak, or valley can have a height or depth between 0 microns and 20 microns. In some examples, a depth of a valley corresponds to a distance that the valley extends into the surface of the metal substrate and a height of an asperity or peak corresponds to a distance that the asperity or peak protrudes, or projects, from the surface of the metal substrate. As an example, each asperity, peak, or valley can have a height or depth between 0 microns and 10 microns. As another example, each asperity, peak, or valley can have a height or depth between 1 micron and 8 microns. As still another example, each asperity, peak, or valley can have a height or depth between 5 microns and 7 microns. In some examples, a valley caused by the first texture can have a depth that is different from a height of an asperity or peak caused by the second texture. In some examples, each asperity, peak, or valley can have any suitable height, depth, shape, or size. In such examples, the height, depth, shape, or size of the surface texture features applied on the metal substrate can vary depending on a desired application or use of the metal substrate. While in this example, the first pair of work rolls causes a negatively skewed area on the metal substrate and the second pair of work rolls causes a positively skewed area on the metal substrate, the present disclosure is not limited to such configurations. Rather, in other examples, the first or second pair of work rolls can apply any texture to the surface of the metal substrate.

In some examples, the second texture is applied on the surface of the metal substrate such that the second texture at least partially overlaps the first texture. In another example, the second texture is applied at a location on the surface of the metal substrate that is adjacent to a location of the first texture. In this manner, a single pass of the metal substrate between multiple pairs of work rolls during rolling operations can cause the metal substrate to have a duplex or triplex surface (e.g., a surface that includes two or three textures, features, or patterns) as the metal substrate passes between each pair of work rolls. In some examples, the metal substrate makes multiple passes through the multiple pairs of work rolls.

If desired, each pair of work rolls can apply varying work roll pressures to the metal substrate as the metal substrate passes between each pair of work rolls. In some examples, the work roll pressure imparted on the metal substrate by each pair of work rolls is an amount of pressure that allows a thickness of the metal substrate to remain substantially constant (e.g., there is substantially no reduction in the thickness of the metal substrate) as the metal substrate passes between the pairs of work rolls. More specifically, each pair of work rolls can apply a fixed or predetermined amount of force that generates a work roll pressure below a yield strength of the metal substrate, which can prevent the thickness of the metal substrate from being reduced as the metal substrate passes between each pair of work rolls. In some examples, as described above, each pair of work rolls can include at least a work roll having a texture that, in combination with the load that generates a work roll pressure less than the yield strength of the metal substrate, creates areas where the localized pressure on the surface of the metal substrate is greater than the yield strength of the metal substrate to cause localized partial plastic deformation at the localized areas on the surface of the metal substrate. In this manner, the work rolls can be used to cause localized plastic deformation on the surface of the metal substrate to impress various localized textures on the surface of the metal substrate without changing the thickness of the metal substrate.

In some examples, impressing different textures, patterns, or features on the surface of the metal substrate causes the metal substrate to have enhanced characteristics, including, for example, increased lubricant retention, increased destacking capability, increased resistance spot weldability, increased adhesion, reduced galling, enhanced optical properties, frictional uniformity, etc. Further, applying a work roll pressure to the metal substrate that is below the yield strength of the metal substrate to impress various textures on the surface of the metal substrate can maintain a desired thickness of the metal substrate as the various textures are applied.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative examples but, like the illustrative examples, should not be used to limit the present disclosure.

FIG. 1 is a schematic cross-sectional view of an exemplary mill stand 102 that includes a pair of work rolls 104*a-b* for applying a texture on a surface 108, 110 of a metal substrate 106. The mill stand 102 can be any structure supporting various components used for rolling a metal substrate 106. The metal substrate 106 can be a metal sheet or metal alloy sheet including, for example, an aluminum sheet or an aluminum alloy sheet. In other examples, a substrate may be various other metal or non-metal substrates.

In the example depicted in FIG. 1, the mill stand 102 includes work rolls 104*a-b*. Each work roll 104*a-b* is a cylindrical work roll made of any suitable material for rolling a metal substrate (e.g., the metal substrate 106). For example, each work roll 104*a-b* can be a cylindrical steel work roll, or a work roll of any other suitable material. Each work roll 104*a-b* can be any size. As an example, each work roll 104*a-b* can have a diameter between approximately 30 mm and approximately 60 mm. In another example, each work roll 104*a-b* can be of any suitable size (e.g., any suitable diameter). The work rolls 104*a-b* can be driven by a motor or other device for driving the work rolls 104*a-b* and causing them to rotate. The mill stand 102 can have various other configurations.

The work rolls 104*a-b* receive the metal substrate 106, which is drawn through a space (i.e., roll gap) between the work rolls 104*a-b* as the work rolls 104*a-b* rotate. The work rolls 104*a-b* may be supported by one or more support or backup rolls, such as backup rolls 105*a-b*. In some examples, a diameter of each backup roll 105*a-b* may be larger than a diameter of each work roll 104*a-b*, although each backup roll 105*a-b* and each work roll 104*a-b* can be of any size. Each backup roll 105*a-b* may be a hard metallic roll or any other suitable roll. The backup rolls 105*a-b* may be coupled to the respective work rolls 104*a-b* for preventing vertical deflection in the work rolls 104*a-b*. In some cases, the backup rolls 105*a-b* help prevent the work rolls 104*a-b* from separating as the metal substrate 106 passes between the work rolls 104*a-b*. In other examples, the backup rolls 105*a-b* may be composed of multiple sections along the length of the work rolls, or may be supported by sectioned backup bearings.

In some examples, one or both of work rolls 104*a-b* are textured using a texturing technique including, for example, electro-discharge texturing ("EDT"), electrodeposition texturing, electron beam texturing ("EBT"), laser beam texturing, electrofusion coating, etc. Texturing each work roll 104*a-b* modifies a topography (e.g., a natural or artificial physical feature) of a surface of the work roll 104*a-b*. In some cases, texturing each work roll 104*a-b* causes each work roll 104*a-b* to have a texture on a surface of the work roll 104*a-b*. In one example, the work rolls 104*a-b* each have the same texture (e.g., are textured using the same texturing technique). In another example, each work roll 104*a-b* has a different texture. In still another example, only one of the work rolls 104*a-b* has a texture. For example, work roll 104*a* may be a textured work roll (e.g., a textured steel work roll) and work roll 104*b* may not have a texture or may be a soft or smooth work roll (e.g., a polyurethane work roll), or vice versa.

In some examples, the mill stand 102 includes hydraulic cylinders 107*a-b* that apply a load or force to the work rolls 104*a-b* and cause the work rolls 104*a-b* to apply a work roll pressure to the metal substrate 106. For example, the hydraulic cylinders 107*a-b* may be communicatively coupled to a processing device, which may receive signals for controlling the hydraulic cylinders 107*a-b* to cause the hydraulic cylinders 107*a-b* to apply the load or force to the work rolls 104*a-b* to cause the work rolls 104*a-b* to apply the work roll pressure to the metal substrate 106. As an example, the processing device may receive signals for controlling the hydraulic cylinders 107*a-b* to cause the hydraulic cylinders 107*a-b* to move in a vertical direction if the metal substrate 106 being processed is passing through the work rolls 104*a-b* in a substantially horizontal direction. For example, the processing device may cause the hydraulic cylinder 107*a* to move down to apply a load on the work roll 104*a*, which causes the work roll 104*a* to apply a work roll pressure on the metal substrate 106. In some examples, the processing device may cause each hydraulic cylinder 107*a-b* to move in a vertical direction for reducing a gap between the work rolls 104*a-b*, which may cause the work rolls 104*a-b* to apply the work roll pressure on the metal substrate 106. For example, the processing device may cause the hydraulic cylinder 107*a* to move down and cause the hydraulic cylinder 107*b* to move up, which may cause the work rolls 104*a-b* to move in a corresponding manner to reduce a gap between the work rolls 104*a-b*. In some examples, the work rolls 104*a-b* may apply a work roll pressure on the metal substrate 106 as the gap between the work rolls 104*a-b* is reduced. In some examples, the load applied by the hydraulic cylinders

107*a-b* on the work rolls 104*a-b* is a predetermined or fixed load (e.g., a predetermined or fixed amount of force). As an example, the processing device may receive signals indicating the predetermined or fixed load and the processing device can control the hydraulic cylinders 107*a-b* to cause the hydraulic cylinders 107*a-b* to apply the predetermined or fixed load to the work rolls 104*a-b*.

In some examples, the work roll pressure applied by the work rolls 104*a-b* on the metal substrate 106 is below a yield strength of the metal substrate 106. The yield strength of the metal substrate 106 corresponds to an amount of stress or pressure at which plastic deformation occurs through a portion of the thickness or gauge of the metal substrate 106 (e.g., an amount of strength or pressure that can cause a permanent change in a substantial portion of the thickness or gauge of the metal substrate 106). In this example, because the work roll pressure applied by the work rolls 104*a-b* on the metal substrate 106 is below the yield strength of the metal substrate 106, the thickness of the metal substrate 106 can remain substantially constant (e.g., there is substantially no reduction in the thickness of the metal substrate) as the metal substrate passes between the work rolls 104*a-b*.

The work rolls 104*a-b* apply the work roll pressure to the metal substrate 106 to apply or impress a texture, pattern, or feature on one or both surfaces 108, 110 of the metal substrate 106. For example, the work rolls 104*a-b* can apply the work roll pressure to the metal substrate 106 to transfer a texture of one or both work rolls 104*a-b* to one or both surfaces 108,110 of the metal substrate 106. As an example, the work rolls 104*a-b* can apply the work roll pressure to the metal substrate 106 such that a texture of work roll 104*a* can be transferred or applied to a surface 108 of the metal substrate 106. As another example, the work rolls 104*a-b* can apply the work roll pressure to the metal substrate 106 such that a texture of work roll 104*b* can be transferred or applied to a surface 110 of the metal substrate 106. In some examples, one or both of the work rolls 104*a-b* may apply a texture to a surface of the metal substrate 106. As a non-limiting example, the work roll 104*a* may be a textured roll (e.g., an EDT steel work roll) for transferring a texture to the surface 108 and the work roll 104*b* may not be textured or may be a soft or smooth work roll (e.g., a polyurethane work roll). The work roll 104*a* may apply a texture to the surface 108 and the work roll 104*b* may not alter the surface 110 of the metal substrate 106. In another non-limiting example, each of work rolls 104*a-b* may be a textured roll (e.g., an EDT-textured steel work roll) for transferring a texture to the surfaces 108, 110 of the metal substrate 106.

In some examples, while a work roll pressure applied by the work rolls 104*a-b* to the metal substrate 106 is below the yield strength of the metal substrate, a texture of one or both work rolls 104*a-b* can have a topography that creates localized areas on the surface 108, 110 of the metal substrate 106 where a localized pressure applied to the metal substrate 106 is above the yield strength of the metal substrate 106. For example, a surface profile of the texture on one or both work rolls 104*a-b*, in combination with the work roll pressure applied by the work rolls 104*a-b* that is less than the yield strength of the metal substrate 106, can create areas on the surface 108, 110 where a localized pressure on the surface 108,110 is greater than the yield strength of the metal substrate 106. In some examples, because the localized pressure created at the localized areas by the texture on the work rolls 104*a-b* is greater than the yield strength of the metal substrate 106, the texture can cause the work rolls 104*a-b* to create localized areas of plastic deformation on the surface 108, 110 and impress a texture, pattern, or feature to the one or both surfaces 108, 110 of the metal substrate 106. In this example, the localized pressure created at the localized areas on the surfaces 108, 110 by the texture on the work rolls 104*a-b* is greater than yield strength of the metal substrate 106, while the work roll pressure applied by the work rolls 104*a-b* is below the yield strength of the metal substrate. Thus, in some examples, the work rolls 104*a-b* can be used to cause localized areas of plastic deformation on the one or both surfaces 108, 110 of the metal substrate 106 (e.g., to transfer textures from the work rolls 104*a-b* to the surfaces 108, 110 of the metal substrate) without substantially changing the overall thickness of the metal substrate.

The one or both work rolls 104*a-b* are configured to apply a texture, pattern, or feature to the one or both surfaces 108, 110 of the metal substrate 106 to cover a percentage or an amount of a surface area of the metal substrate 106. For example, the work rolls 104*a-b* can apply a work roll pressure that is below the yield strength of the metal substrate 106 and a topography of a texture on one or both work rolls 104*a-b* can create a localized pressure that is above the yield strength of the metal substrate 106 at particular areas on the metal substrate such that a percentage of the surface area of the metal substrate 106 is covered with the texture applied by the one or both work rolls 104*a-b*. In this example, the localized pressure created by the topography of the texture on one or both work rolls is above the yield strength of the metal substrate 106 at the particular areas on the metal substrate 106 to cause localized areas of plastic deformation to apply the texture on a percentage of the surface area of the metal substrate 106 while the work roll pressure at other areas of the metal substrate 106 is below the yield strength of the metal substrate such that the other areas of the metal substrate are not subject to plastic deformation (e.g., remain un-deformed).

As a non-limiting example, the work roll 104*a* may apply a work roll pressure that is below the yield strength of the metal substrate 106; and the work roll pressure, along with a topography of a texture on the work roll 104*a*, create localized pressures above the yield strength that cause the work roll 104*a* to create localized plastic deformation on approximately half of a surface area of the surface 108 of the substrate 106 and transfer the texture from the work roll 104*a* to cover approximately half of the surface area of the surface 108 of the substrate 106 in a single pass of the metal substrate 106 between the work rolls 104*a-b*. In this example, the texture on the work roll 104*a* does not create a pressure above the yield strength on the remaining half of the surface area of the surface 108 of the substrate 106, which can leave the remaining half un-deformed (i.e., untextured). Similarly, the work roll 104*b* may apply a work roll pressure that is below the yield strength of the metal substrate 106; and the work roll pressure, along with a texture on the work roll 104*b*, create a localized pressure above the yield strength that causes the work roll 104*b* to create localized plastic deformation on approximately half of a surface area of the surface 110 and transfer the texture from the work roll 104*b* to cover approximately half of the surface area of the surface 110 in a single pass of the metal substrate 106 between the work rolls 104*a-b*.

As another example, the work roll 104*a* may apply a work roll pressure that is below the yield strength of the metal substrate 106; and the work roll pressure, along with a texture on the work roll 104*a*, create a localized pressure above the yield strength that causes the work roll 104*a* to create localized plastic deformation on less than approximately half of a surface area of the surface 108 and transfer the texture from the work roll 104*a* to cover less than approximately half of the surface area of the surface 108 in a single pass of the metal substrate 106 between the work rolls 104*a-b*. As another example, the work roll 104*b* may apply a work roll pressure that is below the yield strength of the metal substrate 106; and the work roll pressure, along with a texture on the work roll 104*b*, create a localized pressure above the yield strength that causes the work roll 104*b* to create localized plastic deformation on less than approximately half of a surface area of the surface 110 and transfer the texture from the work roll 104*b* to cover less than approximately half of the surface area of the surface 108 in a single pass of the metal substrate 106 between the work rolls 104*a-b*.

As another example, the work roll 104*a* may apply a work roll pressure that is below the yield strength of the metal substrate 106; and the work roll pressure, along with a texture on the work roll 104*a*, create a localized pressure above the yield strength that causes the work roll 104*a* to create localized plastic deformation on less than approximately one-third of a surface area of the surface 108 and transfer the texture from the work roll 104*a* to cover less than approximately one-third of the surface area of the surface 108 in a single pass of the metal substrate 106 between the work rolls 104*a-b*. As another example, the work roll 104*b* may apply a work roll pressure that is below the yield strength of the metal substrate 106; and the work roll pressure, along with a texture on the work roll 104*b*, create a localized pressure above the yield strength that causes the work roll 104*b* to create localized plastic deformation on less than approximately one-third of a surface area of the surface 110 and transfer the texture from the work roll 104*b* to cover less than approximately one-third of the surface area of the surface 108 in a single pass of the metal substrate 106 between the work rolls 104*a-b*.

As another example, the work roll 104*a* may apply a work roll pressure that is below the yield strength of the metal substrate 106; and the work roll pressure, along with a texture on the work roll 104*a*, create a localized pressure above the yield strength that causes the work roll 104*a* to create localized plastic deformation on less than approximately one-fifth of a surface area of the surface 108 and transfer the texture from the work roll 104*a* to cover less than approximately one-fifth of the surface area of the surface 108 in a single pass of the metal substrate 106 between the work rolls 104*a-b*. As another example, the work roll 104*b* may apply a work roll pressure that is below the yield strength of the metal substrate 106; and the work roll pressure, along with a texture on the work roll 104*b*, create a localized pressure above the yield strength that causes the work roll 104*b* to create localized plastic deformation on less than approximately one-fifth of a surface area of the surface 110 and transfer the texture from the work roll 104*b* to cover less than approximately one-fifth of the surface area of the surface 108 in a single pass of the metal substrate 106 between the work rolls 104*a-b*.

In some examples, the percentage or amount of the surface area of the metal substrate 106 that is covered by a texture during a single pass of the metal substrate 106 between work rolls 104*a-b* may depend on one or more factors, including, for example, a work roll pressure applied by the work rolls 104*a-b* on the metal substrate 106, a material of the metal substrate 106, a size of the metal substrate 106, a size of each work roll 104*a-b*, etc.

As described above, in some examples, the work roll pressure applied to the metal substrate 106, along with a topography of a texture on the work rolls 104*a-b*, creates localized areas on the surface of the metal substrate 106 where the localized pressure on the areas is greater than the yield strength of the metal substrate 106 to cause localized partial plastic deformation at the areas on the surface. In this example, pressure at other areas on the surface of the metal substrate 106 is below the yield strength of the metal substrate 106 such that the other areas of the metal substrate are not subject to plastic deformation (e.g., remain un-deformed). For example, the work rolls 104*a-b* can apply a work roll pressure below the yield strength of the metal substrate 106 and the work roll pressure, along with a texture on the work rolls 104*a-b*, create a localized pressure above the yield strength that causes the work rolls 104*a-b* to create localized plastic deformation on first portions or locations on the surface of the metal substrate 106 to cause the surface of the metal substrate 106 to have an asperity, peak, or valley at the first locations. In this example, the remaining locations or portions of the surface are not subject to plastic deformation and therefore remain substantially un-deformed.

In some examples, because the localized pressure on the surface of the metal substrate 106 is only above the yield strength at particular locations on the surface of the metal substrate 106, while the work roll pressure applied by the work rolls 104*a-b* is below the yield strength of the metal substrate, the work rolls 104*a-b* can be used to cause localized areas of plastic deformation on the one or both surfaces 108, 110 the metal substrate 106 (e.g., to transfer textures from the work rolls 104*a-b* to the surfaces 108, 110 of the metal substrate) without changing the overall thickness of the metal substrate 106 as the metal substrate 106 passes between the pair of work rolls 104*a-b*. In addition, because the localized pressure created by a texture of one or both work rolls 104*a-b* at the localized areas on the surfaces 108,110 of the metal substrate 106 does not cause a substantial reduction in a thickness of the metal substrate 106 at the localized areas on the surface 108,110 of the metal substrate 106 or across a width or along a length of the metal substrate 106, the work rolls 104*a-b* can be used to cause localized areas of plastic deformation on the one or both surfaces 108, 110 of the metal substrate 106 without changing the overall thickness of the metal substrate 106 as the metal substrate 106 passes between the pair of work rolls 104*a-b*.

As an example, the work rolls 104*a-b* can apply a work roll pressure to the metal substrate 106 that is between approximately 5% and 95% of a pressure that may cause a measurable reduction in the thickness of the metal substrate 106. As another example, the work rolls 104*a-b* can apply a work roll pressure to the metal substrate 106 that is between approximately 50% and 80% of a pressure that may cause a measurable reduction in the thickness of the metal substrate 106. In some examples, applying a low work roll pressure to the metal substrate 106 (e.g., a pressure below the yield strength of the metal substrate 106) allows for the use of a support structure that is lighter than a conventional mill stand to support the work rolls 104*a-b* applying the work roll pressure to the metal substrate 106.

In some examples, the work rolls 104*a-b* apply a work roll pressure on the metal substrate 106 such that a length of the metal substrate 106 remains substantially constant (e.g., there is substantially no elongation or increase in the length of the metal substrate 106) as the metal substrate 106 passes between the work rolls 104*a-b*. As an example, the work roll pressure applied by the work rolls 104*a-b* to the metal substrate 106 may cause the length of the metal substrate 106 to increase between approximately 0% and approximately 1%. As another example, the length of the metal substrate 106 may increase by less than approximately 0.5% as the metal substrate 106 passes between the work rolls 104*a-b*. More specifically, the work rolls 104*a-b* apply a work roll pressure that is below a yield strength of the metal substrate 106, which can prevent the thickness of the metal substrate 106 from being substantially reduced (e.g., reduced by more than 1%) as the metal substrate 106 passes between the work rolls 104*a-b*. During texturing, to prevent the thickness of the metal substrate from being reduced, a load is imparted to the work rolls 104*a-b* such that the work rolls 104*a-b* impart a work roll pressure on the metal substrate 106 that is below the yield strength of the metal substrate 108 as the metal substrate 106 passes between the work rolls 104*a-b*. Because the work roll pressure imparted by the work rolls 104*a-b* on the metal substrate 106 is below the yield strength of the metal substrate 106, the thickness of the metal substrate 106 remains substantially constant (e.g., the thickness of the metal substrate 106 remains substantially constant and there is substantially no reduction in the thickness of the metal substrate 106).

In various examples, a variation in thickness across the width of the metal substrate 106 as a result of the texturing process is less than approximately 1% after the texture has been applied. In various examples, a variation in thickness across the width of the metal substrate 106 as a result of both the texturing process and rolling during coil-to-coil processing is less than approximately 2%.

Figure 2:
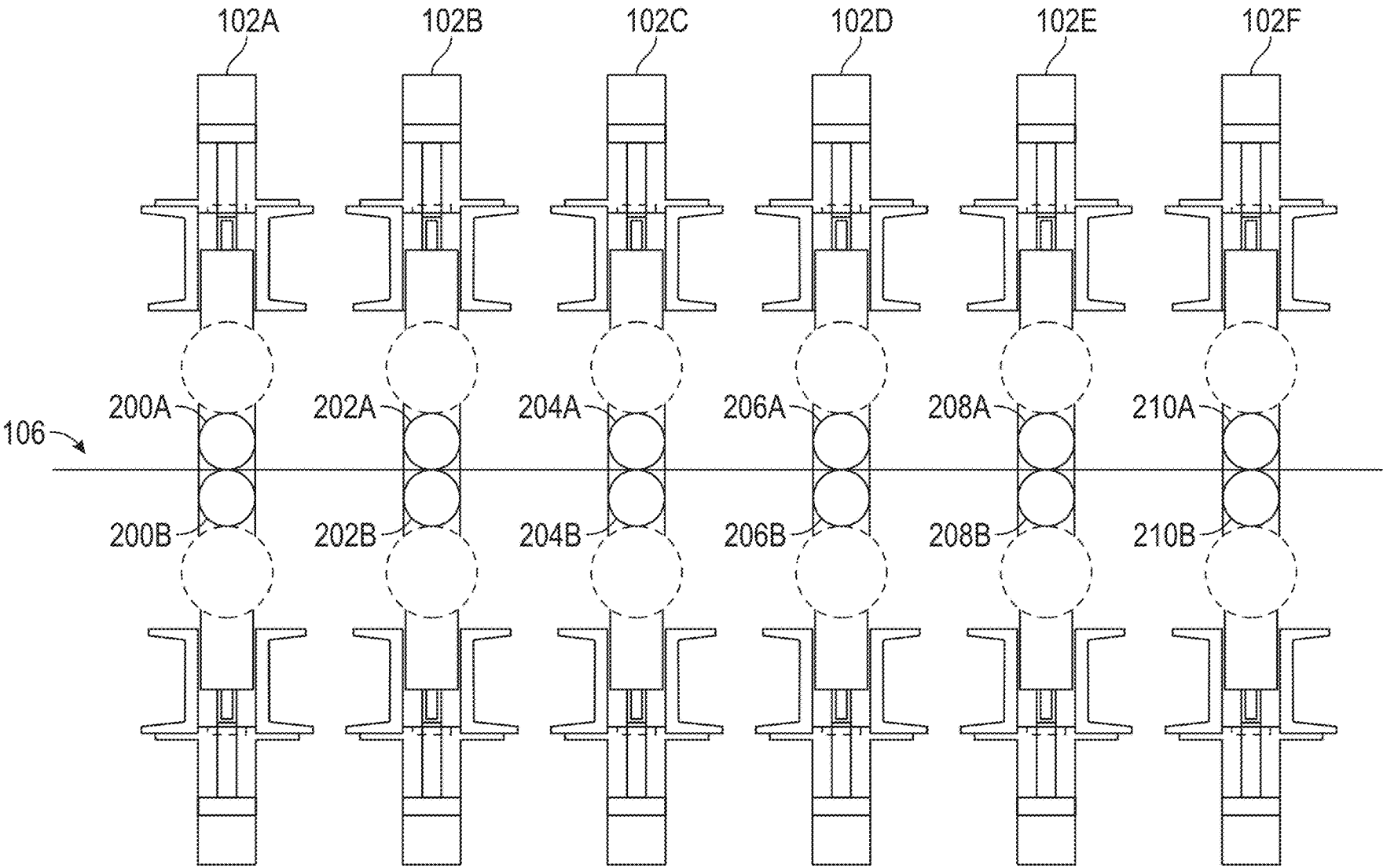
FIG. 2 is a schematic cross-sectional view of multiple mill stands that each include pairs of work rolls for applying multiple textures on a surface of a metal substrate, according to one example of the present disclosure.

As described above, multiple pairs of work rolls are used to apply various textures, features, or patterns on a surface of the metal substrate. FIG. 2 is a schematic cross-sectional view of multiple mill stands 102*a-f* that each include pairs of work rolls 200*a-b*, 202*a-b*, 204*a-b*, 206*a-b*, 208*a-b*, 210*a-b* for applying multiple textures on a surface of a metal substrate. In the example depicted in FIG. 2, each mill stand 102*a-f* can be configured in substantially the same manner as mill stand 102 of FIG. 1 and each work roll in the pairs of work rolls 200*a-b*, 202*a-b*, 204*a-b*, 206*a-b*, 208*a-b*, 210*a-b* can be configured in substantially the same manner as the work rolls 104*a-b* of FIG. 1. Although FIG. 2 illustrates six mill stands, any suitable number of stands may be used.

In some examples, each pair of work rolls 200*a-b*, 202*a-b*, 204*a-b*, 206*a-b*, 208*a-b*, 210*a-b* applies a work roll pressure to a metal substrate 106 to apply a texture on a surface of the metal substrate 106 (e.g., the surface 108 of FIG. 1) as the metal substrate 106 passes between each pair of work rolls 200*a-b*, 202*a-b*, 204*a-b*, 206*a-b*, 208*a-b*, 210*a-b*. In some examples, any suitable texturing technique is applied to at least one work roll in each pair of work rolls 200*a-b*, 202*a-b*, 204*a-b*, 206*a-b*, 208*a-b*, 210*a-b* to cause the work roll in each pair of work rolls 200*a-b*, 202*a-b*, 204*a-b*, 206*a-b*, 208*a-b*, 210*a-b* to have a texture. In some cases, at least one of the textures of at least one work roll of work rolls 200*a-b*, 202*a-b*, 204*a-b*, 206*a-b*, 208*a-b*, 210*a-b* is different from a texture of another work roll 200*a-b*, 202*a-b*, 204*a-b*, 206*a-b*, 208*a-b*, 210*a-b*. In this way, the texture on the work roll of work rolls 200*a-b*, 202*a-b*, 204*a-b*, 206*a-b*, 208*a-b*, 210*a-b* can be applied on the surface of the metal substrate 106 to apply different textures on the surface of the metal substrate 106.

As an example, one or both of work rolls 200*a-b* can have a first texture, which can be applied to the surface of the metal substrate 106 as the metal substrate 106 passes between the pair of work rolls 200*a-b*. One or both of work rolls 202*a-b* may have a second texture that is different from the first texture and which can be applied to the surface of the metal substrate 106 as the metal substrate 106 passes between the pair of work rolls 202*a-b*. In some examples, the first texture transferred or applied to the surface of the metal substrate 106 by the work rolls 200*a-b* can be different from the second texture applied or transferred to the surface of the metal substrate 106 by the work rolls 202*a-b*. For example, the first texture can have a size, shape, depth, height, coarseness, and/or concentration that is different from a size, shape, depth, height, coarseness, and/or concentration of the second texture. As an illustrative example, the first texture applied by the work rolls 200*a-b* can cause a first portion of the surface of the metal substrate 106 to be a negatively skewed area that can include a valley and the second texture applied by the work rolls 202*a-b* can cause a second portion of the surface of the metal substrate 106 to be a positively skewed area that can include an asperity or a peak. In this example, each asperity, peak, or valley can be of any shape or size. For example, each asperity, peak, or valley can have a depth or height between 0 microns and 20 microns. As another example, each asperity, peak, or valley can have a depth or height between 0 microns and 10 microns. As another example, each asperity, peak, or valley can have a height or depth between 1 micron and 8 microns. As still another example, each asperity, peak, or valley can have a depth or height between 5 and 7 microns. In some examples, each asperity, peak, or valley can have any suitable height, depth, shape, or size. In such examples, the height, depth, shape, or size of the asperity, peak, or valley or texture applied on the metal substrate 106 can vary depending on a desired application or use of the metal substrate 106. In some examples, a negatively skewed area caused by the first texture can include valleys with a depth that is different from a height of asperities or peaks within a positively skewed area caused by the second texture. As another illustrative example, the first texture can cause the first portion of the metal substrate 106 to have a concentration of valleys and the second texture can cause the second portion of the metal substrate to have a different concentration of asperities or peaks. While in this example, the pair of work rolls 200*a-b* causes a negatively skewed area on the metal substrate 106 and the pair of work rolls 202*a-b* causes a positively skewed area on the metal substrate 106, the present disclosure is not limited to such configurations. Rather, in other examples, the pair of work rolls 200*a-b*, 202*a-b* can apply any texture to the surface of the metal substrate 106.

If desired, one or both of work rolls 204*a-b* can have a third texture, which can be applied to the surface of the metal substrate 106 as the metal substrate 106 passes between the pair of work rolls 204*a-b*. Any one of work rolls 206*a-b*, 208*a-b*, 210*a-b* can have the same or different textures as the first, second and third textures.

In some examples, one or more work rolls of the pair of work rolls 200*a-b*, 202*a-b*, 204*a-b*, 206*a-b*, 208*a-b*, 210*a-b* may apply the same texture to the surface of the metal substrate 106 as other pairs of work rolls. As one non-limiting example, one or both of work rolls 200*a-b* may apply a first texture to the surface of the metal substrate 106, one or both of work rolls 202*a-b* may apply a second texture to the surface of the metal substrate 106, and one or both of work rolls 204*a-b* may apply a third texture to the surface of the metal substrate 106. One or both of work rolls 206*a-b* may have the same texture as the work rolls 200*a-b* (e.g., the first texture) and may apply the first texture on the surface of the metal substrate 106, or one or both of work rolls 206*a-b* may have the same texture as the work rolls 202*a-b* (e.g., the second texture). One or both of work rolls 208*a-b* may have the same texture as the work rolls 202*a-b* (e.g., the second texture) and may apply the second texture on the surface of the metal substrate 106, or one or both of work rolls 208*a-b* may have the same texture as the work rolls 200*a-b* (e.g., the first texture). One or both of work rolls 210*a-b* may have the same texture as the work rolls 204*a-b* (e.g., the third texture) and may apply the third texture on the surface of the metal substrate 106, or one or both of work rolls 210*a-b* may have the same texture as the work rolls 200*a-b* or 202*a-b* (e.g., the first or the second texture). In some cases, the work rolls are configured so that only two textures are applied to the metal substrate 106; in others, the work rolls are configured so that more than three textures are applied.

As another non-limiting example, one or both work rolls 200*a-b* may apply a first texture to the surface of the metal substrate 106 and one or both work rolls 202*a-b* and/or 204*a-b* may apply the same texture (e.g., the first texture) to the surface of the metal substrate 106. One or more work rolls 206 *a-b* may apply a second texture to the surface of the metal substrate 106 and one or both work rolls 208*a-b* and/or 210*a-b* may apply the same texture (e.g., the second texture) to the surface of the metal substrate 106.

The metal substrate 106 can make one or more passes between each pair of work rolls 200*a-b,* 202*a-b,* 204*a-b,* 206*a-b,* 208*a-b* and/or 210*a-b*. As one non-limiting example, one or both of work rolls 200*a-b* may apply a first texture to the surface of the metal substrate 106, one or both of work rolls 202*a-b* may apply a second texture to the surface of the metal substrate 106, and/or one or both work rolls 204*a-b* may apply a third texture to the surface of the metal substrate 106. The metal substrate 106 may make another pass between work rolls 200*a-b,* 202*a-b* and/or 204*a-b,* which can re-apply the first, second, and third textures on the surface of the metal substrate 106. If desired, work rolls 206*a-b,* 208*a-b* and/or 210*a-b* may apply any desired combination of the first, second, and/or third textures, or may apply different textures. Other combinations and variations are envisioned.

In various examples, one or more of the work rolls 200*a-b,* 202*a-b,* 204*a-b,* 206*a-b,* 208*a-b,* 210*a-b* can have a relatively smooth outer surface such that the work roll can provide a desired flatness profile (e.g., substantially flat, curved, wavy, etc.) on the metal substrate 106 and can smooth the topography of the metal substrate 106. In this example, one or more of the other work rolls 200*a-b,* 202*a-b,* 204*a-b,* 206*a-b,* 208*a-b,* 210*a-b* can have a textured surface such that the work roll can impress various textures, features, or patterns on the surface of the metal substrate 106 without reducing the overall thickness of the metal substrate 106. For example, the work rolls 200*a-b* can each have a relatively smooth outer surface such that the work rolls 200*a-b* can provide a desired flatness profile on the metal substrate 106 and can smooth the topography of the metal substrate 106 (e.g., to have a surface roughness lower than about 0.4-0.6 μm). In this example, the work roll 210*a* can have a surface texture such that the work roll 210*a* can impress a texture, feature, or pattern on the surface of the metal substrate 106 without reducing the overall thickness of the metal substrate 106. While in this example, the work rolls 200*a-b* can each have a relatively smooth surface to provide a desired flatness profile on the metal substrate 106 and to smooth the topography of the metal substrate 106 and the work roll 210*a* can have a surface texture for impressing a texture, feature, or pattern on the surface of the metal substrate 106, the present disclosure is not limited to such configurations. Rather, in other examples, any of the work rolls 200*a-b,* 202*a-b,* 204*a-b,* 206*a-b,* 208*a-b,* 210*a-b* can have a relatively smooth surface to provide a desired flatness profile on the metal substrate 106 and to smooth the topography of the metal substrate 106 and any of the work rolls 200*a-b,* 202*a-b,* 204*a-b,* 206*a-b,* 208*a-b,* 210*a-b* can have a surface texture for impressing a texture, feature, or pattern on the surface of the metal substrate 106.

In this manner, the work rolls 200*a-b,* 202*a-b,* 204*a-b,* 206*a-b,* 208*a-b,* 210*a-b* may apply any combination of textures, patterns, or features on the surface of the metal substrate 106 as the metal substrate passes between the pairs of work rolls 200*a-b,* 202*a-b,* 204*a-b,* 206*a-b,* 208*a-b,* 210*a-b*.

In some examples, the various textures may be applied on the surface of the metal substrate 106 in an overlapping or adjacent manner. As an example, one or both work rolls 200*a-b* may apply the first texture at a first location on the surface of the metal substrate 106, one or both work rolls 202*a-b* may apply the second texture on the surface of the metal substrate 106 to overlap the first texture, and one or both work rolls 204*a-b* may apply the third texture at a second location on the surface of the metal substrate 106 adjacent to the first location (e.g., adjacent to the location of the first and second textures). Various other patterns are contemplated.

In some examples, passing the metal substrate 106 between the pairs of work rolls 200*a-b,* 202*a-b,* 204*a-b,* 206*a-b,* 208*a-b,* 210*a-b* can cause the metal substrate 106 to have a duplex or triplex surface after a single pass of the metal substrate 106 between the pairs of work rolls 200*a-b,* 202*a-b,* 204*a-b,* 206*a-b,* 208*a-b,* 210*a-b*. A duplex surface refers to a surface having two textures, features, or patterns. A triplex surface refers to a surface having three textures, features, or patterns. The metal substrate 106 may have any number of textures, features, or patterns on a surface of the metal substrate 106 after a single pass of the metal substrate between the pairs of work rolls 200*a-b,* 202*a-b,* 204*a-b,* 206*a-b,* 208*a-b,* 210*a-b*.

Each pair of work rolls 200*a-b,* 202*a-b,* 204*a-b,* 206*a-b,* 208*a-b,* 210*a-b* can apply a texture, pattern, or feature to the surface of the metal substrate 106 to cover a percentage or an amount of a surface area of the metal substrate 106. For example, each pair of work rolls 200*a-b,* 202*a-b,* 204*a-b,* 206*a-b,* 208*a-b,* 210*a-b* may apply a different texture to the surface of the metal substrate 106 that covers less than approximately half of the surface area of the metal substrate 106 in a single pass of the metal substrate 106 between the pair of work rolls 200*a-b,* 202*a-b,* 204*a-b,* 206*a-b,* 208*a-b,* 210*a-b*. In some cases, each pair of work rolls 200*a-b,* 202*a-b,* 204*a-b,* 206*a-b,* 208*a-b,* 210*a-b* may apply a different texture to the surface of the metal substrate 106 that covers less than approximately one third of the surface area of the metal substrate 106 in a single pass of the metal substrate 106 between the pair of work rolls 200*a-b,* 202*a-b,* 204*a-b,* 206*a-b,* 208*a-b,* 210*a-b*. As an example, the pair of work rolls 200*a-b* may apply a first texture on the surface of the metal substrate 106 that covers approximately 20% of the surface in a single pass of the metal substrate 106 between the pair of work rolls 200*a-b*. The pair of work rolls 202*a-b* may apply a second texture on the surface of the metal substrate 106 that covers approximately 6% of the surface of the metal substrate 106 in a single pass of the metal substrate 106 between the pair of work rolls 202*a-b*. The pair of work rolls 204*a-b* may apply a third texture on the surface of the metal substrate 106 that covers approximately 15% of the surface in a single pass of the metal substrate 106 between the pair of work rolls 204*a-b*. Other variations and combinations are possible.

In some examples, each pair of work rolls 200*a-b,* 202*a-b,* 204*a-b,* 206*a-b,* 208*a-b,* 210*a-b* applies a work roll pressure on the metal substrate 106. The work roll pressure, along with a pressure created by a texture, pattern, or feature on the work rolls 200*a-b,* 202*a-b,* 204*a-b,* 206*a-b,* 208*a-b,* 210*a-b,* creates localized plastic deformation on the surface of the metal substrate 106 for applying the texture, pattern, or feature on the surface of the metal substrate 106. The work roll pressure applied by each pair of work rolls 200*a-b,* 202*a-b,* 204*a-b,* 206*a-b,* 208*a-b,* 210*a-b* can be the same or different. As a non-limiting example, the pair of work rolls 200*a-b* may apply a first work roll pressure on the metal substrate 106 for applying a first texture on the surface of the metal substrate. The pair of work rolls 202*a-b* may apply a second work roll pressure on the metal substrate 106 for applying another texture on the surface of the metal substrate. As described above, the work roll pressure applied by each pair of work rolls 200*a-b,* 202*a-b,* 204*a-b,* 206*a-b,* 208*a-b,* 210*a-b* on the metal substrate 106 is below a yield strength of the metal substrate, which may allow a thickness of the metal substrate to remain substantially constant (e.g., not be reduced) as the metal substrate 106 passes between each pair of work rolls. In this manner, the pairs of work rolls 200*a-b,* 202*a-b,* 204*a-b,* 206*a-b,* 208*a-b,* 210*a-b* can apply various textures on the surface of the metal substrate with substantially no reduction in the thickness of the metal substrate 106 as the metal substrate 106 passes between the pairs of work rolls 200*a-b,* 202*a-b,* 204*a-b,* 206*a-b,* 208*a-b,* 210*a-b.*

Figure 3:
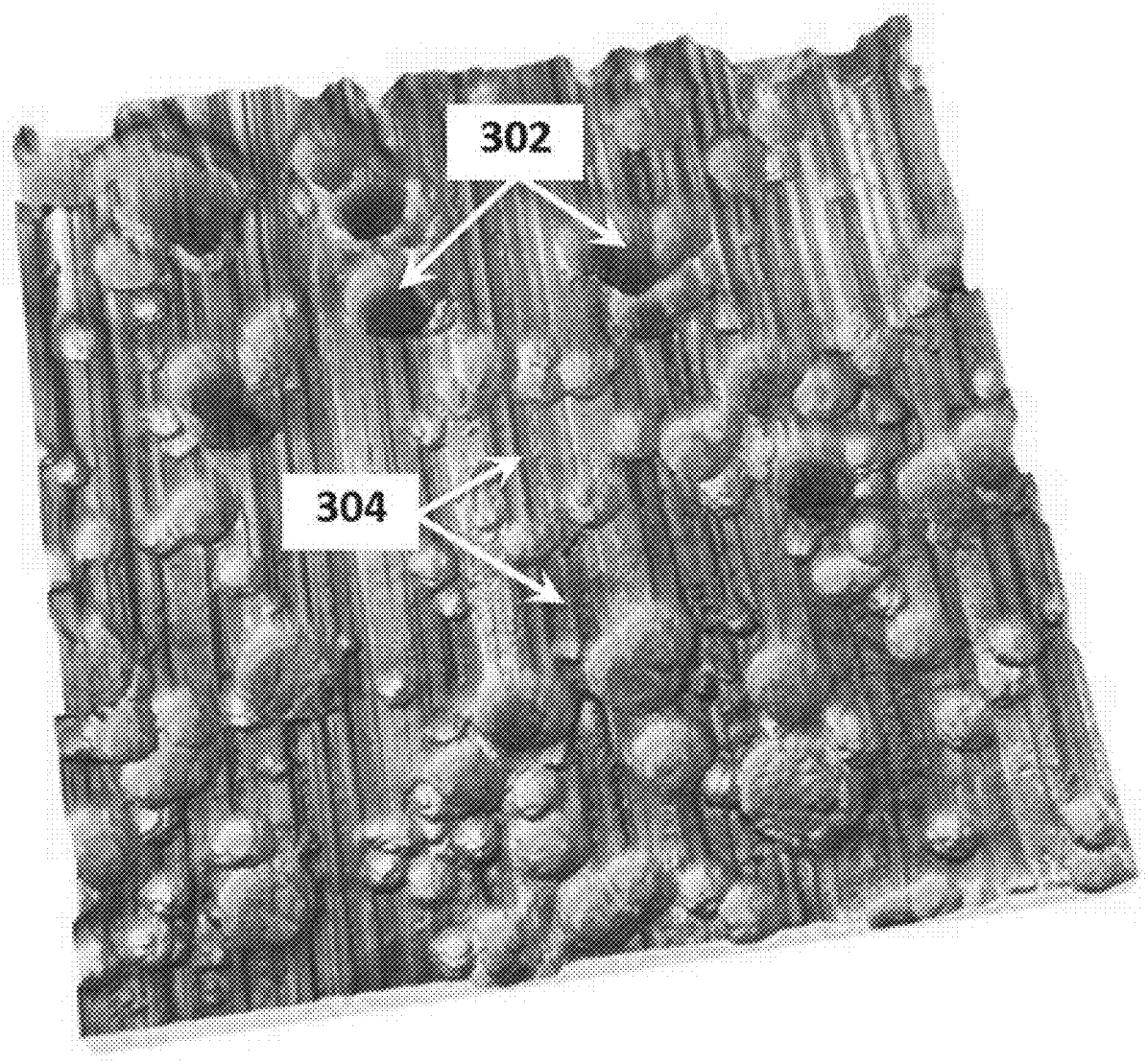
FIG. 3 is an image of a metal substrate having negatively skewed areas within positively skewed areas, according to one example of the present disclosure.

Applying different textures, patterns, or features on the surface of the metal substrate 106 using more than one pair of work rolls (such as, but not limited to, work rolls 200*a-b,* 202*a-b,* 204*a-b,* 206*a-b,* 208*a-b,* and/or 210*a-b*)can cause the metal substrate 106 to have enhanced characteristics. For example, a first texture applied on a portion of the surface of the metal substrate 106 (e.g., by a first work roll such as work roll 200*a*) may cause a first portion of the surface to be a positively skewed area that includes an asperity or peak (e.g., have peaks extending out of the surface of the metal substrate 106), which can increase de-stacking capabilities of the metal substrate 106 or reduce electrical constant resistance of the metal substrate 106. A second texture applied on a second portion of the surface of the metal substrate 106 (e.g., by a second work roll such as work roll 202*a*) may cause the second portion of the surface to be a negatively skewed area that includes a valleys (e.g., have valleys extending into the surface of the metal substrate 106), which can increase a volume of lubricant stored and retained on the metal substrate 106. For example, FIG. 3 is an image of a metal substrate having negatively skewed areas 302 within positively skewed areas 304.

Figure 4:
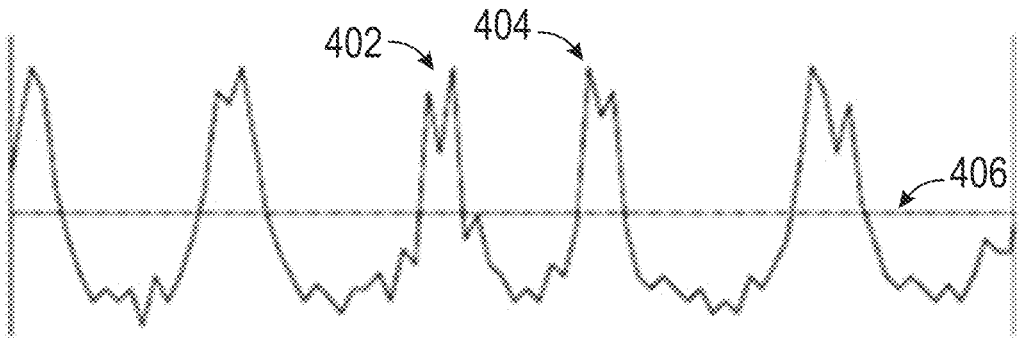
FIG. 4 is a graph depicting an example of microscopic asperities that can be included in a positively skewed area on a metal substrate surface, according to one example of the present disclosure.

FIG. 4 is a graph depicting an example of microscopic asperities that can be included in a positively skewed are on a metal substrate surface. In the example depicted in FIG. 4, the graph depicts peaks 402, 404 that extend out of the surface of a metal substrate, according to one example of the present disclosure. In the example depicted in FIG. 4, the line or axis 406 represents a mean or average value of heights of asperities on a surface of the metal substrate along the length or width of the metal substrate.

Figure 5:
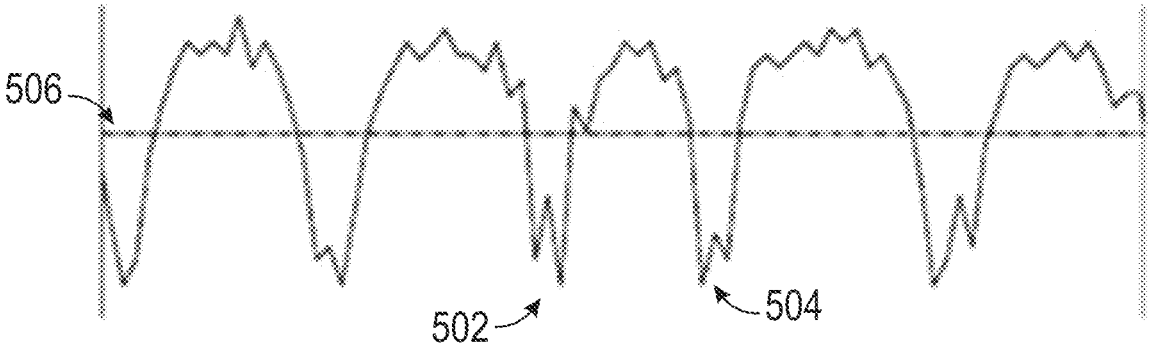
FIG. 5 is a graph depicting an example of microscopic valleys that can be included in a negatively skewed area on a metal substrate surface, according to one example of the present disclosure.

FIG. 5 is a graph depicting an example of microscopic valleys that can be included in a negatively skewed area on a metal substrate surface. In the example depicted in FIG. 5, the graph depicts valleys 502, 504 that extend into the surface of a metal substrate, according to one example of the present disclosure. In the example depicted in FIG. 5, the line or axis 506 represents a mean or average value of heights of asperities on a surface of the metal substrate along the length or width of the metal substrate.

Returning to FIG. 2, a third texture applied on another portion of the surface of the metal substrate 106 (e.g., by a third work roll such as work roll 204*a*) may cause the portion of the surface to have increased optical properties (e.g., increased specularity). In other examples, the various textures, patterns, or features applied on the surface of the metal substrate 106 may cause the metal substrate 106 to have any other enhanced characteristic, including, but not limited to, increased resistance spot weldability, improved adhesion, reduced galling on forming tools, a gloss finish on the surface of the metal substrate 106 (e.g., a relatively uniform glossiness with a slightly matted appearance), an isotropic finish on the surface (e.g., a surface that is substantially identical in all directions), frictional uniformity, etc.

In some examples, more than one pair of work rolls (such as, but not limited to, work rolls 200*a-b,* 202*a-b,* 204*a-b,* 206*a-b,* 208*a-b,* and/or 210*a-b*)can be used to apply different textures, patterns, or features on a surface of a metal substrate 106 during any part of a metal substrate rolling process. For example, the work rolls 200*a-b,* 202*a-b,* 204*a-b,* 206*a-b,* 208*a-b,* 210*a-b* can apply the different textures to the metal substrate 106 prior to a solution heat treatment step in a continuous annealing line or surface finishing line, prior to cleaning and rinsing stages, prior to applying a surface pre-treatment, after solution heat treatment and cleaning stages, etc. As another example, the work rolls 200*a-b,* 202*a-b,* 204*a-b,* 206*a-b,* 208*a-b,* 210*a-b* can apply the different textures to the metal substrate 106 at various temperatures, including, for example, ambient temperatures (e.g., 20-25 degrees Celsius), temperatures up to 100 degrees Celsius or above, or any other temperature.

Although FIG. 2 illustrates six stands and six pairs of work rolls, any number of stands, work rolls, or pairs of work rolls can be used to apply different textures, patterns, or features on a surface of a metal substrate. Furthermore, while FIG. 2 illustrates the work rolls 200*a-b,* 202*a-b,* 204*a-b,* 206*a-b,* 208*a-b,* 210*a-b* in a particular configuration (e.g., in a horizontal sequence or linear arrangement), any configuration of multiple work rolls may be used to apply different textures, patterns, or features on a surface of a metal substrate. Moreover, the number of passes of a metal substrate (e.g., the metal substrate 106) between any number of work rolls or pairs of work rolls can vary to achieve the desired properties or textures on a surface of the metal substrate. In addition, a percentage or an amount of a surface area of the metal substrate covered by a texture transferred from a work roll can vary to achieve the desired properties or textures on the surface of the metal substrate. Further, the number of different textures applied to the metal substrate can vary to achieve the desired properties or textures on the surface of the metal substrate. In addition, the specific textures applied to the metal substrate can vary to achieve the desired properties or textures on the surface of the metal substrate.

Figure 6:
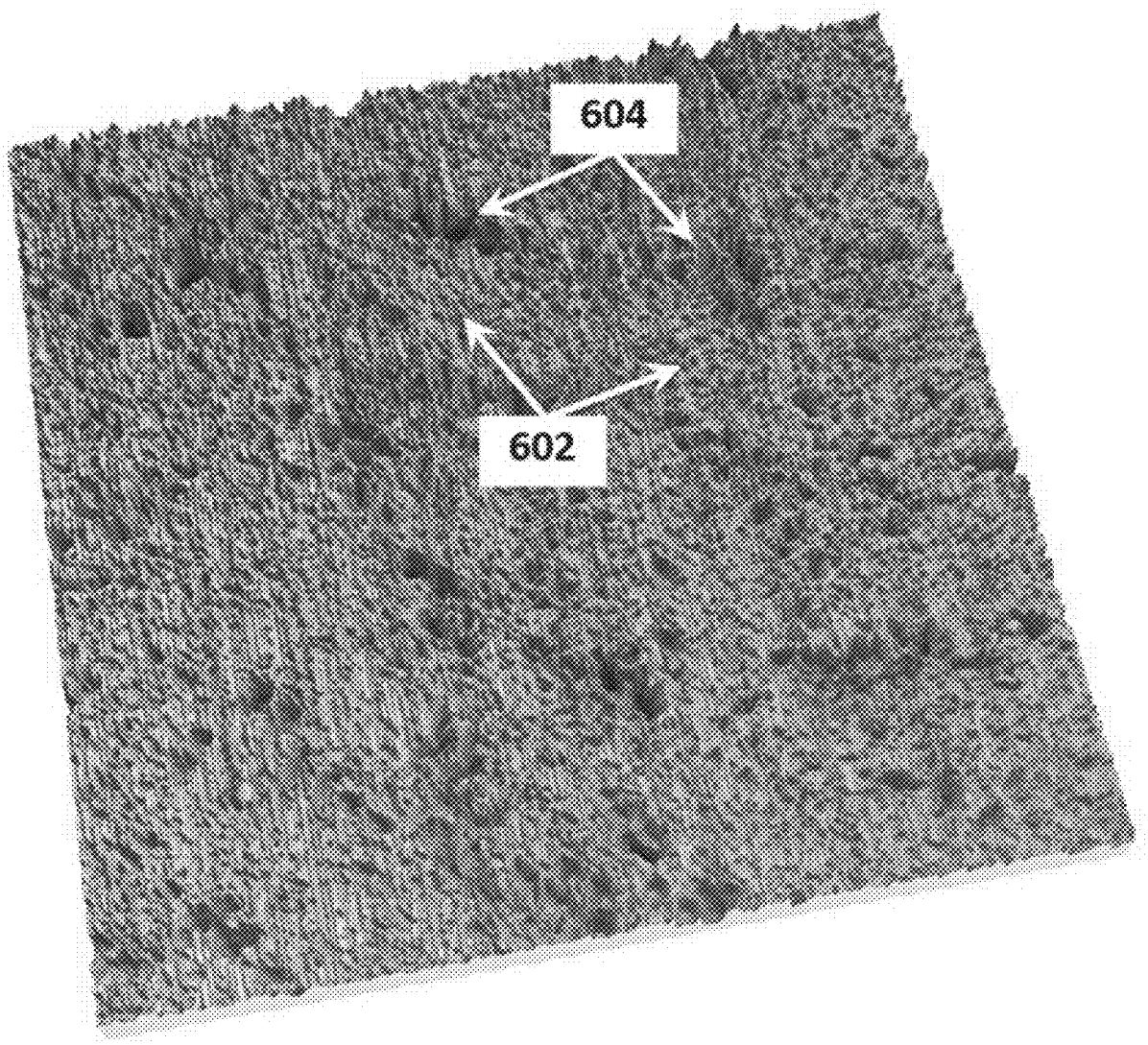
FIG. 6 is an image of a metal substrate having multiple micro-textures, features, or patterns on its surface, according to one example of the present disclosure.

FIG. 6 is an image of a metal substrate having multiple micro-textures, features, or patterns on a surface of the metal substrate. In the example depicted in FIG. 6, the image depicts smooth textured areas 602 and coarse textured areas 604 on the surface of the metal substrate, according to one example of the present disclosure. In this example, the metal substrate can have a duplex or triplex surface texture (e.g., a surface that includes a combination of two or three different textures).

Figure 7:
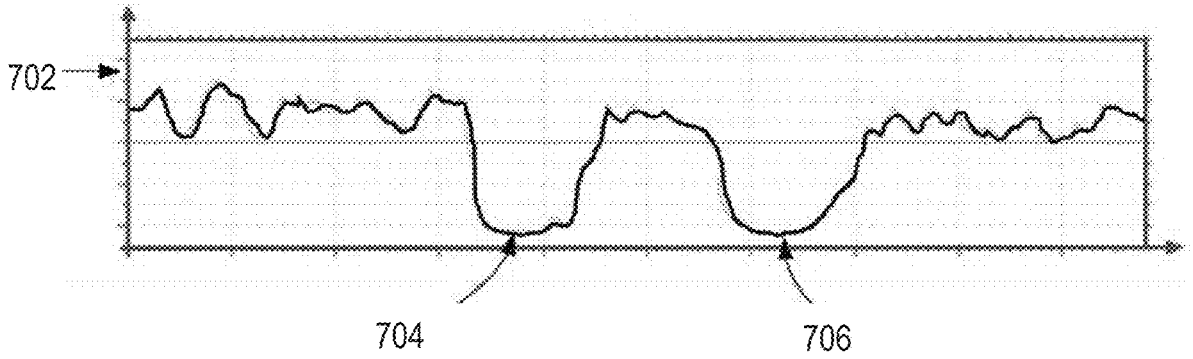
FIG. 7 is a graph depicting an example of a metal substrate including a negatively skewed area, according to one example of the present disclosure.

FIG. 7 is a graph depicting an example of a metal substrate including a negatively skewed area, according to one example of the present disclosure. In the example depicted in FIG. 7, the graph depicts an axis 702, which represents a surface profile of the metal substrate. In this example, the graph depicts valleys 704, 706 that extend into the surface of the metal substrate, which can create an overall negative skewness in the metal substrate, according to one example of the present disclosure. In this example, the graph also depicts small peaks or asperities that project or extend from the surface of the metal substrate.

Figure 8:
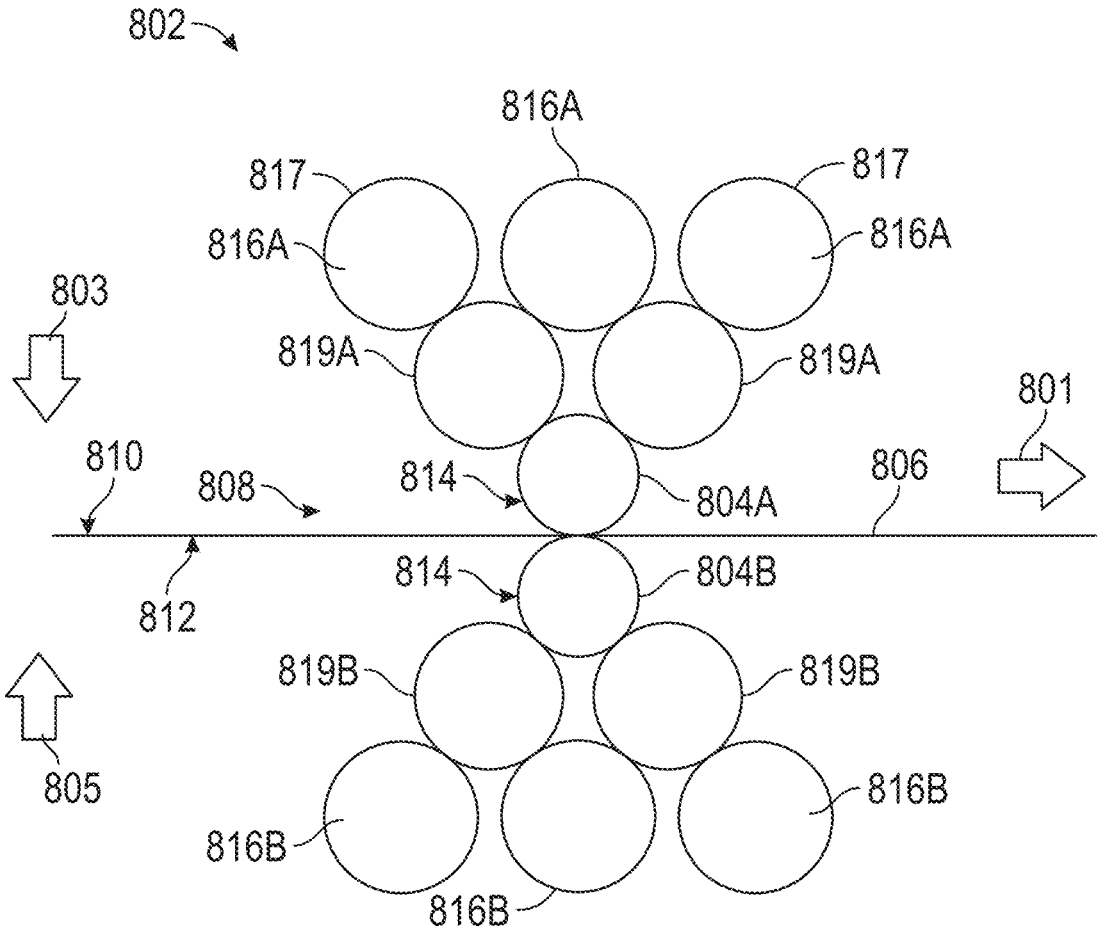
FIG. 8 is a schematic example of a work stand and work rolls for applying a texture on a surface of a metal substrate, according to one example of the present disclosure.
Figure 9:
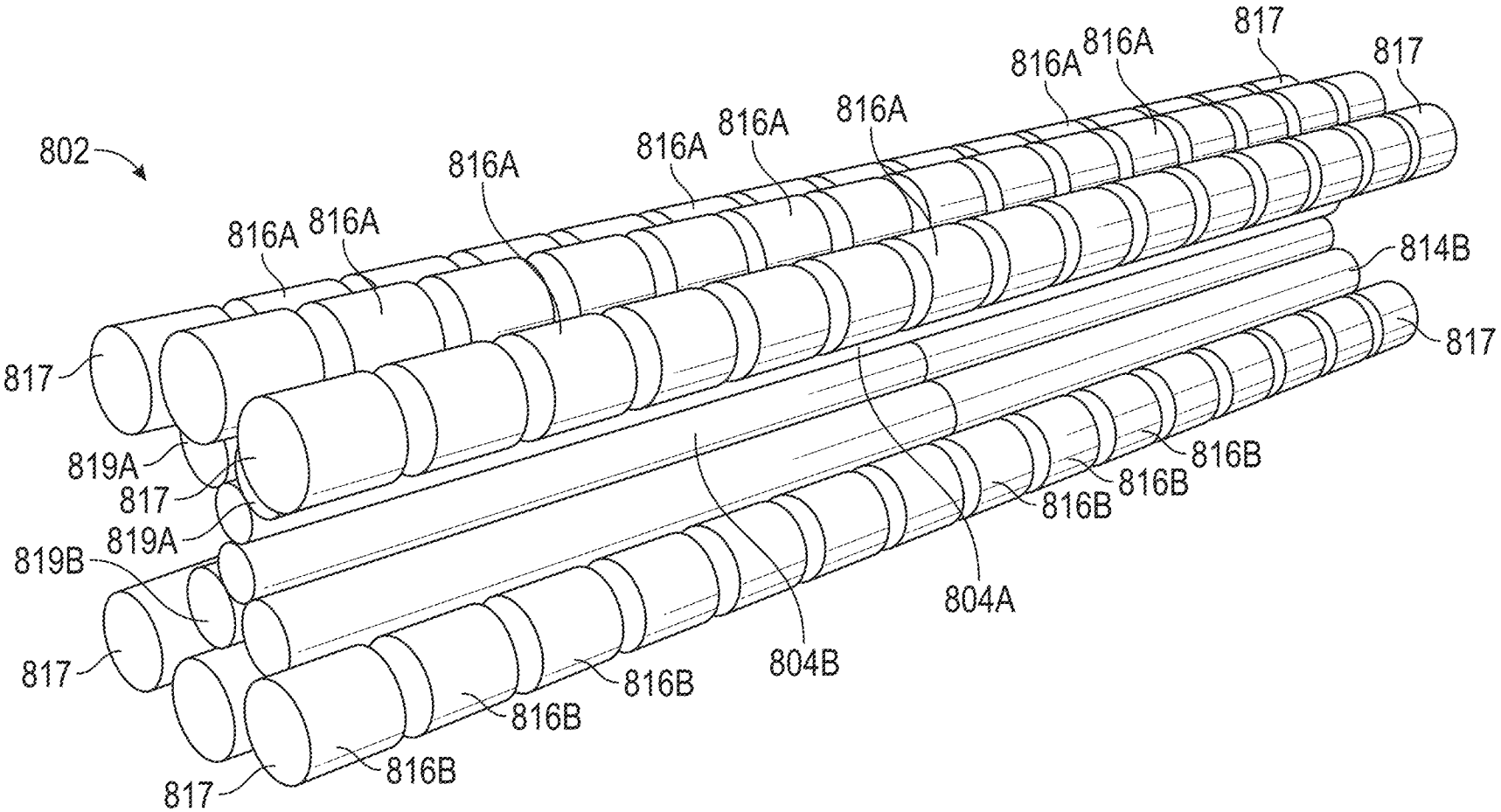
FIG. 9 is another schematic view of the work stand of FIG. 1

In some examples, any number or type of work rolls, mill stands, work stands, etc. can be used to apply a texture on a surface of a metal substrate, according to various examples of the present disclosure. Referring to FIGS. 8-9, in some examples, a work stand 802 can include a pair of vertically aligned work rolls 804*a-b*. The work rolls 804*a-b* can be configured in substantially the same manner as the work rolls 104*a-b* of FIG. 1. A gap 808 is defined between the work rolls 804*a-b* that is configured to receive a metal substrate 806 during texturing of the metal substrate 806. During processing, the work rolls 804*a-b* are configured to contact and apply work roll pressures to the upper surface 810 and the lower surface 812 of the metal substrate 806, respectively, as the metal substrate 806 passes through the gap 808 in a processing direction 801.

The work rolls 804*a-b* can be generally cylindrical and can be made of various materials, such as, for example, steel, brass, and various other suitable materials. The work rolls 804*a-b* can be driven by a motor or other suitable device for driving the work rolls 804*a-b* and causing the work rolls 804*a-b* to rotate. Each work roll 804*a-b* has an outer surface 814 that contacts the surfaces 810 and 812 of the metal substrate 806 during processing. In some examples, the outer surface 814 of one of the work rolls 804*a-b* is of the same roughness or smoother than the incoming strip of metal substrate 806 (e.g., having a surface roughness lower than about 0.4-0.6 μm), such that during processing, the outer surface 814 of the work roll smooths a topography of the surfaces 810 or 812 of the metal substrate 806. In this example, the other work roll of the work rolls 804*a-b* can have a surface texture such that the work roll can impress a texture, feature, or pattern on the other surface 810 or 812 of the metal substrate 806 without reducing the overall thickness of the metal substrate 806. As an example, the outer surface 814 of the work roll 804*a* can be of the same roughness or smoother than the metal substrate 806 to smooth the topography of the surface 810. In this example, the outer surface 814 of the work roll 804*b* can have a surface texture such that the work roll 804*b* can impress a texture, feature, or pattern on the other surface 812 of the metal substrate 806 without reducing the overall thickness of the metal substrate 806. While in this example, the work roll 804*a* has a surface to smooth the surface 810 and the work roll 804*b* has a surface texture for impressing a texture, feature, or pattern on the surface 812, the present disclosure is not limited to such configurations. Rather, in other examples, one or both of the work rolls 804*a-b* can have a surface texture for impressing a texture, feature, or pattern on the surfaces 810 and/or 812. As still another example, one or both of the work rolls may not have the roughness or be smoother than the incoming strip of metal substrate 806.

In other examples, the outer surface(s) 814 of the work rolls 804*a-b* includes one or more textures that are at least partially transferred onto one or both of the surfaces 810 and 812 of the metal substrate 806 as the metal substrate 806 passes through the gap 808, as described in detail above. Surface roughness can be quantified using optical interferometry techniques or other suitable methods. In various examples, one or both work rolls 804*a-b* may be textured through various texturing techniques including, but not limited to, electro-discharge texturing (EDT), electrodeposition texturing, electron beam texturing (EBT), laser beam texturing, electrofusion coatings and various other suitable techniques.

In some examples, the work roll pressures applied by the work rolls 804*a-b* to the metal substrate 806 allow the thickness of the metal substrate 806 and the length of the metal substrate 806 to remain substantially constant (e.g., there is substantially no reduction in the overall thickness of the metal substrate 806 and substantially no increase in the length of the metal substrate 806). As an example, the work roll pressures applied by the work rolls 804*a-b* may cause the thickness of the metal substrate 806 to decrease from about 0.0% and about 1.0%. For example, the thickness of the metal substrate 806 may decrease by less than about 0.5% as the metal substrate 806 passes through the gap 808. As an example, the thickness of the metal substrate 806 may decrease by less than about 0.2% or about 0.1%. In various examples, the work rolls 804*a-b* process the metal substrate 806 such that the work roll pressure is from about 2 to 45 MPa, which is typically less than (and often much less than) the yield point of the material. As one non-limiting example, in some cases, the work roll pressure may be about 15 MPa.

In some examples, the work stand 802 can include one or more intermediate rolls 819*a-b*. In some examples, the intermediate rolls 819*a-b* can be generally cylindrical and made of various materials, such as, for example, steel, brass, or various other suitable materials. The intermediate rolls 819*a-b* can each have a diameter and stiffness equal to or greater than a diameter and stiffness of the work rolls 804*a-b*, although they need not.

The work stand 802 can also include one or more of a plurality of actuators or bearings 816*a-b*. The actuators 816*a-b* can be made of various materials, such as, for example, steel, brass, or various other suitable materials. The actuators 816*a-b* can each have a diameter that is greater than a diameter and stiffness of the work rolls 804*a-b*, although they need not. The number or location of the actuators 816*a-b* should not be considered limiting on the current disclosure. For example, FIG. 8 illustrates an example of a configuration of two actuators 816*a-b* at a corresponding region of the respective work roll 804*a-b*. However, in other examples, one actuator 816*a-b* or more than two actuators 816*a-b* may be provided for the particular region of the respective work rolls 804*a-b*. In some examples where a plurality of actuators 816*a-b* are provided, the actuators 816*a-b* may be arranged in one or more rows. However, the number or configuration of actuators 816*a-b* should not be considered limiting on the current disclosure. Referring to FIG. 9, within each row of actuators 816*a-b*, adjacent actuators 816*a-b* can be spaced apart by an actuator spacing, which is a distance between adjacent ends of adjacent actuators 816*a-b*. In various examples, the actuator spacing is from about 1 mm to about the width of each actuator.

In some examples, the plurality of actuators 816*a-b* are provided to impart localized forces on the respective work rolls 804*a-b* through intermediate rolls 819*a-b*, respectively. For example, actuators 816*a* are provided along the intermediate rolls 819*a* and are configured to apply bearing loads on the intermediate rolls 819*a*, which then transfer the load to the work roll 804*a* such that the work roll 804*a* applies the work roll pressure to the surface 810 of the metal substrate 806. Similarly, actuators 816*b* are provided along the intermediate rolls 819*b* and are configured to apply bearing loads on the intermediate rolls 819*b*, which then transfer the load to the work roll 804*b* such that the work roll 804*b* applies the work roll pressure to the surface 812 of the metal substrate 806. For example, in various cases, the bearings 816*a-b* apply vertical bearing loads when the metal substrate 806 moves horizontally in the direction of movement 801. In some examples, the bearing load is from about 2 kgf to about 20,000 kgf. In some examples, at least some of the bearings 816*a-b* are independently adjustable relative to the respective work roll 804*a-b* such that the localized pressure at discrete locations along the width of the work roll 804*a-b* can be independently controlled. In other examples, two or more bearings 816*a-b* may be adjusted in unison.

As illustrated in FIG. 8, the intermediate rolls 819*a* support the work roll 804*a* and the intermediate rolls 819*b* support the work roll 804*b*. Although two intermediate rolls 819*a* are shown with the work roll 804*a* and two intermediate rolls 819*b* are shown with the work roll 804*b*, the number of intermediate rolls 819*a-b* should not be considered as limiting on the current disclosure. Rather, in other examples, any number of intermediate rolls 819*a-b* can be used to support any number of work rolls 804*a-b*. In some examples, the intermediate rolls 819*a-b* are provided to help prevent the work rolls 804*a-b* from separating as the metal substrate 806 passes through the gap 808. In some examples, the intermediate rolls 819*a-b* are further provided to transfer the localized forces on the respective work rolls 804*a-b* from the respective actuators 816*a-b*.

While in the example depicted in FIG. 8, intermediate rolls 819*a-b* are illustrated, in some examples, the intermediate rolls 819*a-b* may be omitted and the actuators 816*a-b* may directly or indirectly impart forces on the work rolls 804*a-b*, respectively.

In various examples, the actuators 816*a* are provided to impart the forces on the work roll 804*a* and the actuators 816*b* are provided to impart the forces on the work roll 804*b*. The number and configuration of the actuators 816*a-b* should not be considered limiting on the current disclosure as the number and configuration of the actuators 816*a-b* may be varied as desired. In various examples, the actuators 816*a-b* are oriented substantially perpendicular to the processing direction 801. In some examples, each actuator 816*a-b* has a profile with a crown or chamfer across a width of the respective actuator 816*a-b*, where crown generally refers to a difference in diameter between a centerline and the edges of the actuator (e.g., the actuator is barrel-shaped). The crown or chamfer may be from about 0 μm to about 50 μm in height. In one non-limiting example, the crown is about 30 μm. In another non-limiting example, the crown is about 20 μm. In some examples, the crown of the actuators 816*a-b* may be controlled to further control the forces imparted on the work rolls 804*a-b*, respectively. In some examples, the actuators 816*a-b* are individually controlled through a controller (not shown). In other examples, two or more actuators 816*a-b* may be controlled together.

In some cases, during texturing, the upper work roll 804*a* may be actuated in the direction generally indicated by arrow 803 and the lower work roll 804*b* may be actuated in the direction generally indicated by arrow 805. In such examples, the work rolls are actuated against both the upper surface 810 and the lower surface 812 of the metal substrate 806. However, in other examples, only one side of the stand 802 / only one of the work rolls 804*a-b* may be actuated, and actuation indicated by the arrow 803 or actuation indicated by the arrow 805 may be omitted. In such examples, during texturing, the bearings on one side may be frozen and/or may be omitted altogether such that one of the work rolls 804*a-b* is not actuated (i.e., actuation on the metal substrate is only from one side of the metal substrate). For example, in some cases, the lower actuators 816*b* may be frozen such that the lower work roll 104*b* is frozen (and is not actuated in the direction indicated by arrow 805). In other examples, the lower actuators 816*b* may be omitted such that the lower work roll 104*b* is frozen.

In some examples where a plurality of actuators 816*a-b* are provided, the actuators 816*a-b* may be arranged in one or more rows. However, the number or configuration of bearing actuators 816*a-b* should not be considered limiting on the current disclosure. Within each row of actuators 816*a-b*, adjacent actuators 816*a-b* are spaced apart by an actuator spacing, which is a distance between adjacent ends of adjacent actuators 816*a-b*. In various examples, the actuator spacing is from about 1 mm to about the width of each actuator. In certain aspects, a density of the actuators 816*a-b*, or a number of actuators 816*a-b* acting on a particular portion of the work rolls, may be varied along the work rolls. For example, in some cases, the number of actuators 816*a-b* at edge regions of the work rolls may be different from the number of actuators 816*a-b* at a center region of the work rolls.

In some examples, a characteristic of the actuators 816*a-b* may be adjusted or controlled depending on desired location of the particular actuators 816*a-b* along the width of the work rolls. As one non-limiting example, the crown or chamfer of the actuators 816*a-b* proximate to edges of the work rolls may be different from the crown or chamfer of the actuators 816*a-b* towards the center of the work rolls. In other aspects, the diameter, width, spacing, etc. may be controlled or adjusted such that the particular characteristic of the actuators 816*a-b* may be the same or different depending on location. In some aspects, bearings having different characteristics in the edge regions of the work rolls compared to bearings in the center regions of the work rolls may further allow for uniform pressure or other desired pressure profiles during texturing. For example, in some cases, the bearings may be controlled to intentionally change the flatness and/or texture of the metal substrate. As some examples, the actuators 816*a-b* may be controlled to intentionally create an edge wave, create a thinner edge, etc. Various other profiles may be created.

In various examples, in addition to being vertically adjustable to control bearing load, the actuators 816*a-b* may also be laterally adjustable relative to the respective work roll 804*a-b*, meaning that a position of the actuators 816*a-b* along a width of the respective work roll 804*a-b* may be adjusted. For example, in examples where the actuators 816*a-b* are arranged in at least one row, the row includes two edge actuators 817, which are the outermost actuators 816*a-b* of the row of actuators 816*a-b*. In some examples, at least the actuators 817 are laterally adjustable.

Figure 10:
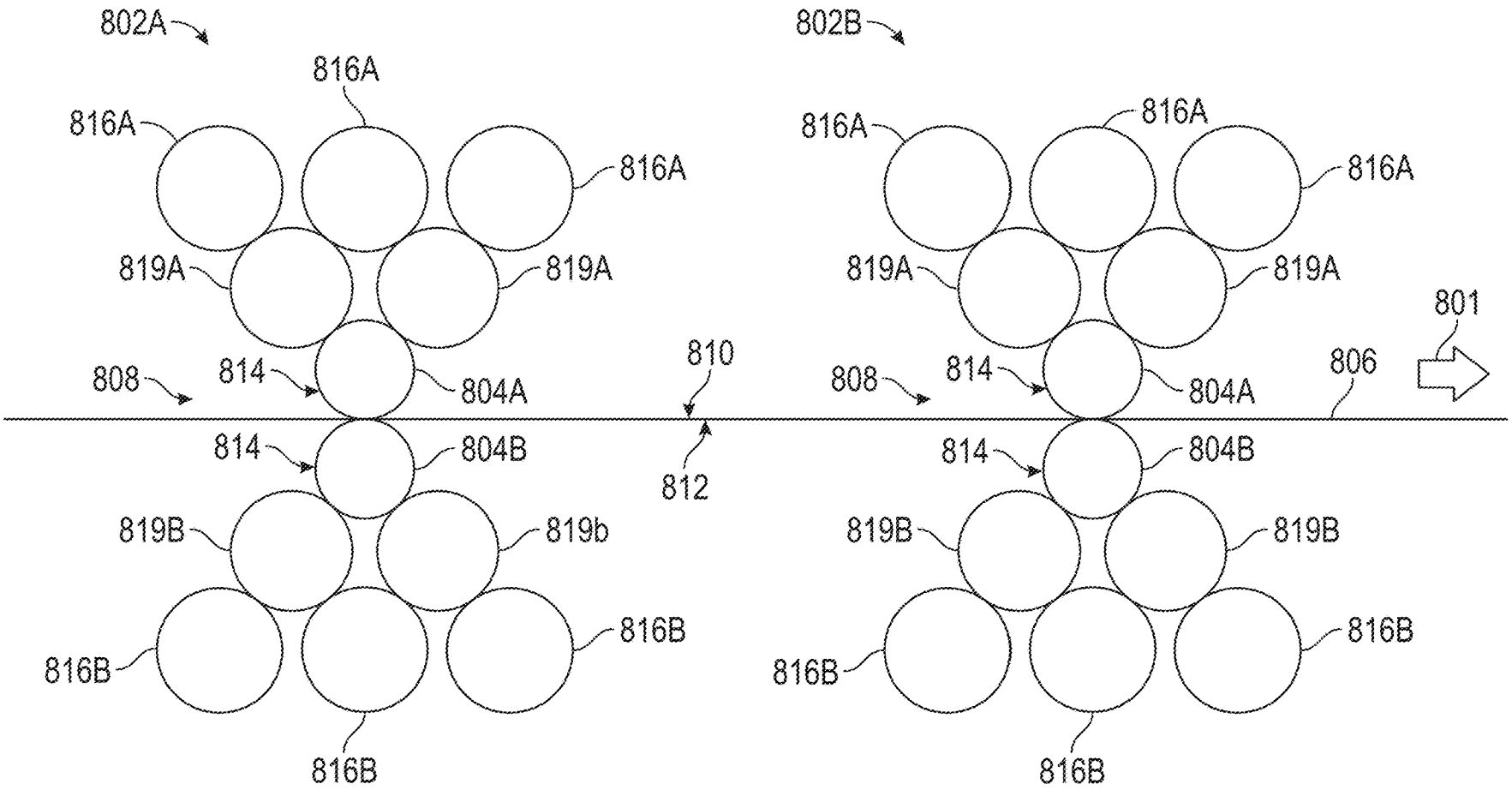
FIG. 10 is a schematic of one or more work stands and work rolls for applying a texture on a surface of a metal substrate, according to one example of the present disclosure.

While in the example depicted in FIG. 8, a single pair of work rolls 804*a-b* is used to apply a texture on a surface of the metal substrate 806, the present disclosure is not limited to such configurations. Rather, in other examples, any number or configuration of work rolls, pairs of work rolls, work stands, etc. can be used to apply a texture on a surface of a metal substrate as described above. For example, FIG. 10 is a schematic of one or more work stands 802*a-b* and work rolls 804*a-b* for applying a texture on a surface of a metal substrate, according to one example of the present disclosure. Compared to the example depicted in FIG. 8, FIG. 10 depicts an example that includes two work stands 802*a-b*. In this example, the work stand 802*a* includes work rolls 804*a-b* that can have a smooth outer surface for simultaneous flattening and smoothing of the metal substrate 806. The work stand 802*b* includes work rolls 804*a-b,* one or both of which can have a texture on the outer surface that is applied to the metal substrate 806. In this example, the work stand 802*a* is upstream of the work stand 802*b*. As noted above, various other implementations and configurations are possible.

In some examples, one side of the work stand may be frozen such that only one side of the stand is actuated (i.e., the stand is actuated only in the direction 803 or only in the direction 805). In such examples, the vertical position of the lower work roll 104*b* is constant, fixed, and/or does not move vertically against the metal substrate.

Figure 11:
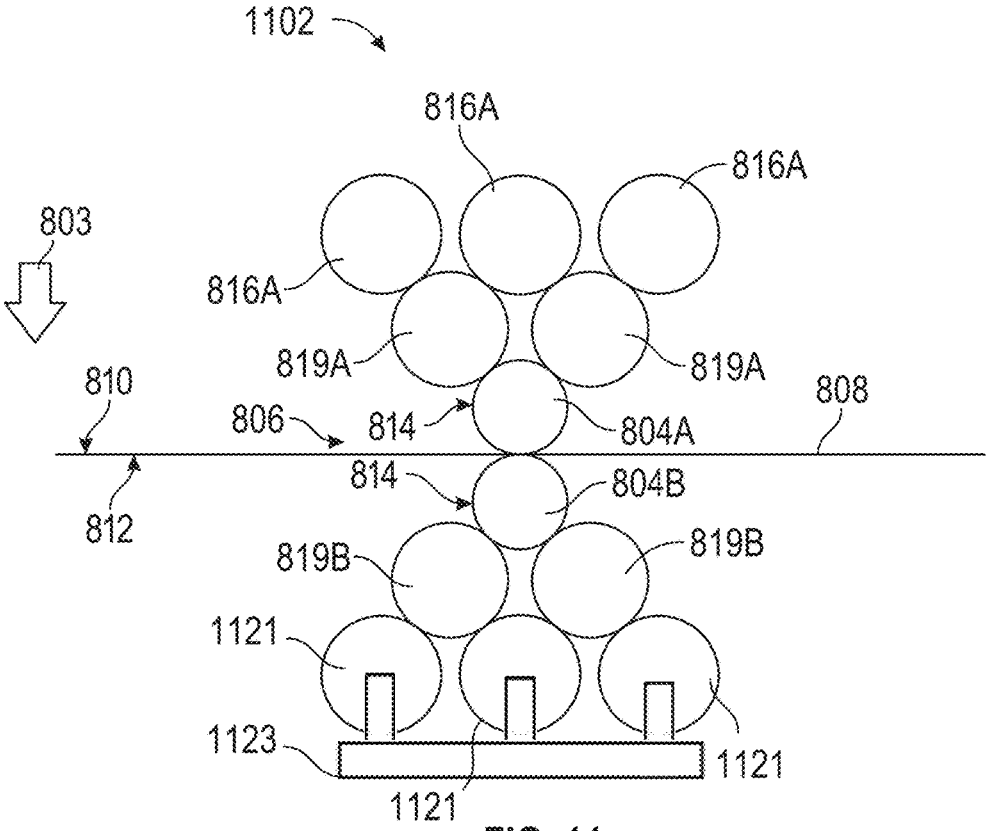
FIG. 11 is a schematic a work stand according to aspects of the present disclosure.
Figure 12:
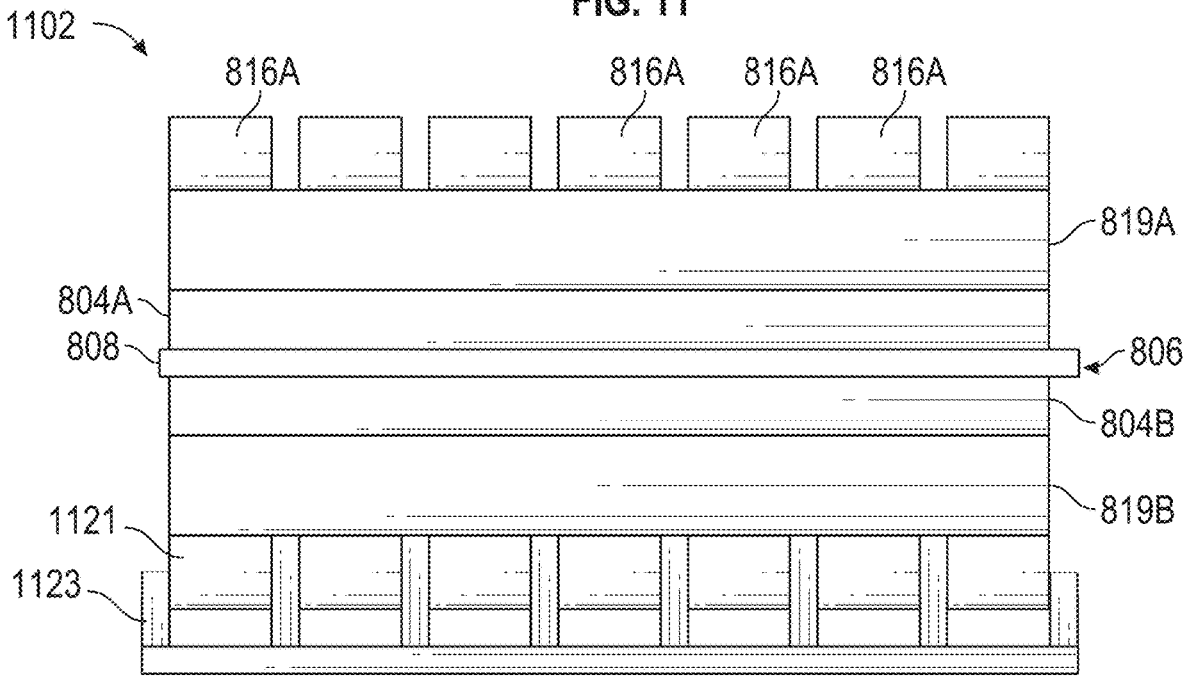
FIG. 12 is a schematic end view of the work stand of FIG. 11.
Figure 13:
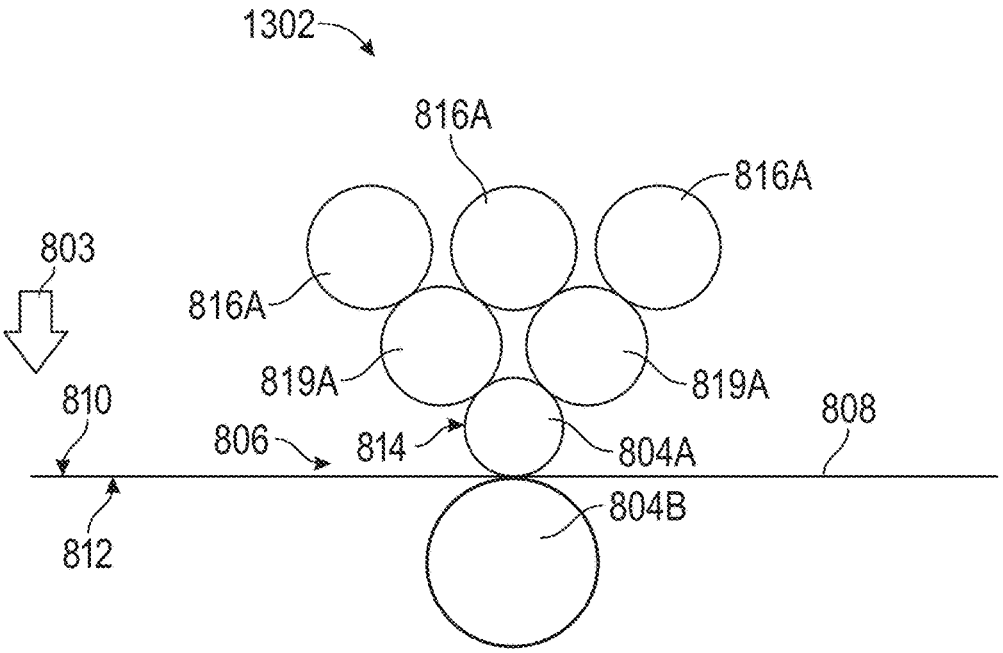
FIG. 13 is a schematic of a work stand according to aspects of the present disclosure.
Figure 14:
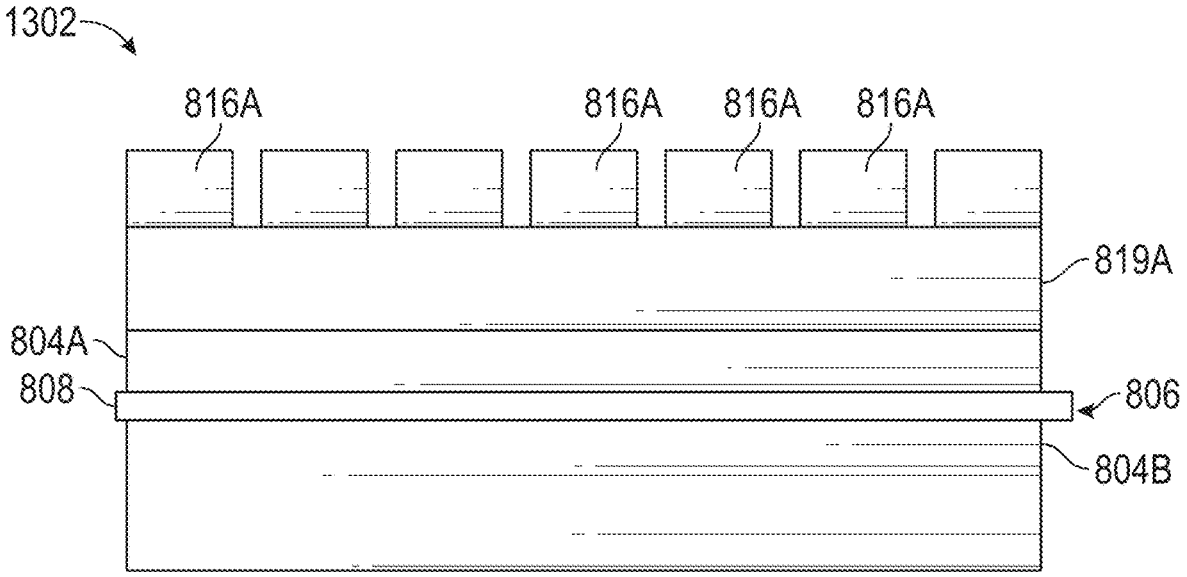
FIG. 14 is a schematic end view of the work stand of FIG. 13.

In some aspects where actuators are included on both the upper and lower sides of the stand, one side of the work stand may be frozen by controlling one set of actuators such that they are not actuated. For example, in some cases, the lower actuators 816*b* may be frozen such that the lower work roll 804*b* not actuated in the direction 805. In other examples, the lower actuators 816*b* may be omitted such that the lower work roll 104*b* is frozen. In other examples, various other mechanisms may be utilized such that one side of the stand is frozen. For example, FIGS. 11 and 12 illustrate an additional example of a work stand where one side is frozen, and FIGS. 13 and 14 illustrate a further example of a work stand where one side is frozen. Various other suitable mechanisms and/or roll configurations for freezing one side of the work stand while providing the necessary support to the frozen side of the work stand may be utilized.

FIGS. 11 and 12 illustrate another example of a work stand 1102. The work stand 1102 is substantially similar to the work stand 802 except that the work stand 1102 includes fixed backup rolls 1121 in place of the lower actuators 816*b*. In this example, the fixed backup rolls 1121 are not vertically actuated, and as such the work stand 1102 is only actuated in the direction 803. Optionally, the backup rolls 1121 are supported on a stand 1123 or other suitable support as desired. Optionally, the stand 1123 supports each backup roll 1121 at one or more locations along the backup roll 1121. In the example of FIGS. 11 and 12, three backup rolls 1121 are provided; however, in other examples, any desired number of backup rolls 1121 may be provided. In these examples, because the backup rolls 1121 are vertically fixed, the lower work roll 804*b* is frozen, meaning that the lower work roll 804*b* is constant, fixed, and/or does not move vertically against the metal substrate. In such examples, the actuation in the stand 1102 during texturing is only from one side of the stand 1102 (i.e., actuation is only from the upper side of the stand with the upper work roll 104*a*).

FIGS. 13 and 14 illustrate another example of a work stand 1302. The work stand 1302 is substantially similar to the work stand 802 except that the intermediate rolls and actuators are omitted, and a diameter of the lower work roll 804*b* is greater than the diameter of the upper work roll 804*a*. In this example, the work stand 1302 is only actuated in the direction 803. In some aspects, the larger diameter lower work roll 804*b* provides the needed support against the actuation such that the desired profile of the metal substrate 808 is created during texturing. It will be appreciated that in other examples, intermediate rolls and/or various other support rolls may be provided with the lower work roll 804*b*. In further examples, the lower work roll 804*b* may have a similar diameter as the upper work roll 804*a* and the work stand further includes any desired number of intermediate rolls and/or support rolls to provide the necessary support to the lower work roll when one side is frozen.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A method for applying textures on a substrate, the method comprising: applying, by a first pair of work rolls, a first texture on a first surface of the substrate, wherein at least one work roll in the first pair of work rolls has the first texture; and applying, by a second pair of work rolls, a second texture on the first surface of the substrate after applying the first texture, the second texture being different from the first texture and wherein at least one work roll in the second pair of work rolls has the second texture and wherein applying the first texture and the second texture comprises: applying, by the first pair of work rolls, a first work roll pressure on the first surface of the substrate and applying, by the second pair of work rolls, a second work roll pressure on the first surface of the substrate, wherein applying the first work roll pressure and the second work roll pressure creates localized areas of plastic deformation on the first surface of the substrate due to a first topography of the first texture and a second topography of the second texture and wherein the first texture and the second texture are applied to the localized areas of the first surface while an overall thickness of the substrate remains substantially constant.

EC 2. The method of any of the preceding or subsequent examples, wherein the first texture has at least one of a size, shape, depth, height or coarseness that is different from at least one of a size, shape, depth, height, or coarseness of the second texture.

EC 3. The method of any of the preceding or subsequent examples, wherein applying the second texture comprises at least partially overlapping the first texture with the second texture on the first surface of the substrate in a single pass of the substrate between the first pair of work rolls and the second pair of work rolls.

EC 4. The method of any of the preceding or subsequent examples, wherein applying the first texture comprises applying the first texture at a first location on the first surface of the substrate and applying the second texture comprises applying the second texture at a second location on the first surface of the substrate that is adjacent to the first location.

EC 5. The method of any of the preceding or subsequent examples, wherein the first work roll pressure and the second work roll pressure applied on the substrate are each below a yield strength of the substrate.

EC 6. The method of any of the preceding or subsequent examples, wherein applying the first texture on the first surface of the substrate comprises applying the first texture to less than approximately half of a surface area of the first surface of the substrate.

EC 7. The method of any of the preceding or subsequent examples, wherein applying the first texture on the first surface of the substrate comprises applying the first texture to less than approximately one-third of a surface area of the first surface of the substrate.

EC 8. The method of any of the preceding or subsequent examples, wherein applying the first texture on the first surface of the substrate comprises applying the first texture to less than approximately one-fifth of a surface area of the first surface of the substrate.

EC 9. The method of any of the preceding or subsequent examples, wherein applying the second texture on the first surface of the substrate comprises applying the second texture to less than approximately half of a surface area of the first surface of the substrate.

EC 10. The method of any of the preceding or subsequent examples, wherein applying the second texture on the first surface of the substrate comprises applying the second texture to less than approximately one-third of a surface area of the first surface of the substrate.

EC 11. The method of any of the preceding or subsequent examples, wherein applying the second texture on the first surface of the substrate comprises applying the second texture to less than approximately one-fifth of a surface area of the first surface of the substrate.

EC 12. The method of any of the preceding or subsequent examples, wherein the substrate is aluminum or an aluminum alloy sheet.

EC 13. The method of any of the preceding or subsequent examples, wherein the first texture comprises a negatively skewed area on a first location of the first surface of the substrate and the second texture comprises a positively skewed area on a second location of the first surface of the substrate, or wherein the first texture comprises a positively skewed area on the first location of the first surface of the substrate and the second texture comprises a negatively skewed area on the second location of the first surface of the substrate.

EC 14. The method of any of the preceding or subsequent examples, wherein at least one of the positively skewed area or the negatively skewed area has asperities or valleys with an average height or depth between 0 microns and 20 microns.

EC 15. The method of any of the preceding or subsequent examples, wherein at least one of the positively skewed area or the negatively skewed area has asperities or valleys with an average height or depth between 1 micron and 8 microns.

EC 16. The method of any of the preceding or subsequent examples, wherein applying, by the first pair of work rolls, the first texture on the first surface of the substrate comprises applying the first texture on the first surface of the substrate by a first work roll of the first pair of work rolls, and further comprising: applying a texture different from the first texture on a second surface of the substrate by a second work roll of the first pair of work rolls.

EC 17. The method of any of the preceding or subsequent examples, wherein applying, by the first pair of work rolls, the first texture on the first surface of the substrate or applying, by the second pair of work rolls, the second texture on the first surface causes less than a one percent reduction in the overall thickness of the substrate.

EC 18. The method of any of the preceding or subsequent examples, wherein applying, by the first pair of work rolls, the first texture on the first surface of the substrate or applying, by the second pair of work rolls, the second texture on the first surface causes less than a one percent increase in an overall length of the substrate.

EC 19. A substrate prepared according to the method of any of the preceding or subsequent examples.

EC 20. A substrate comprising: a first surface having a first texture and a second texture, wherein the first texture is different from the second texture, wherein the first texture has at least one of a size, shape, height, depth, or coarseness that is different from at least one of a size, shape, height, depth, or coarseness of the second texture.

EC 21. The substrate of any of the preceding or subsequent examples, wherein the first texture comprises a negatively skewed area on a first location of the first surface of the substrate and the second texture comprises a positively skewed area on a second location of the first surface of the substrate, or wherein the first texture comprises a positively skewed area on the first location of the first surface of the substrate and the second texture comprises a negatively skewed area on the second location of the first surface of the substrate.

EC 22. The substrate of any of the preceding or subsequent examples, wherein at least one of the positively skewed area or the negatively skewed area has asperities or valleys with an average height or depth between 0 microns and 20 microns.

EC 23. The substrate of any of the preceding or subsequent examples, wherein at least one of the positively skewed area or the negatively skewed area has asperities or valleys with an average height or depth between 1 micron and 8 microns.

EC 24. The substrate of any of the preceding or subsequent examples, wherein the first texture covers less than approximately half of a surface area of the first surface of the substrate.

EC 25. The substrate of any of the preceding or subsequent examples, wherein the second texture covers less than approximately half of a surface area of the first surface of the substrate.

EC 26. The substrate of any of the preceding or subsequent examples, wherein the first texture covers less than approximately one-third of a surface area of the first surface of the substrate.

EC 27. The substrate of any of the preceding or subsequent examples, wherein the second texture covers less than approximately one-third of a surface area of the first surface of the substrate.

EC 28. The substrate of any of the preceding or subsequent examples, wherein the first texture covers less than approximately one-fifth of a surface area of the first surface of the substrate.

EC 29. The substrate of any of the preceding or subsequent examples, wherein the second texture covers less than approximately one-fifth of a surface area of the first surface of the substrate.

EC 30. The substrate of any of the preceding or subsequent examples, wherein the substrate is aluminum or an aluminum alloy sheet.

EC 31. The substrate of any of the preceding or subsequent examples, wherein a second surface of the substrate has at least one of the first texture, the second texture and a third texture, wherein the third texture is different from the first and second textures.

EC 32. The method of any of the preceding or subsequent examples, wherein applying the first work roll pressure on the first surface of the substrate by the first pair of work rolls comprises vertically actuating one work roll of the first pair of work rolls while freezing a vertical position of the other work roll of the first pair of work rolls.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A method for applying textures on a substrate, the method comprising:

applying, by a first pair of work rolls, a first texture on a first surface of the substrate, wherein at least one work roll in the first pair of work rolls has the first texture; and applying, by a second pair of work rolls, a second texture on the first surface of the substrate after applying the first texture, the second texture being different from the first texture and wherein at least one work roll in the second pair of work rolls has the second texture and wherein applying the first texture and the second texture comprises:

applying, by the first pair of work rolls, a first work roll pressure on the first surface of the substrate; and applying, by the second pair of work rolls, a second work roll pressure on the first surface of the substrate, wherein applying the first work roll pressure and the second work roll pressure creates localized areas of plastic deformation on the first surface of the substrate due to a first topography of the first texture and a second topography of the second texture and wherein the first texture and the second texture are applied to the localized areas of the first surface while an overall thickness of the substrate remains substantially constant, wherein each pair of work rolls comprises an upper work roll and a lower work roll, wherein a set of intermediate rolls supports at least one of the upper work roll or the lower work roll, wherein a set of actuators are provided along the set of intermediate rolls and are configured to impart bearing loads on the set of intermediate rolls such that the set of intermediate rolls transfer the loads from the set of actuators to the upper work roll or the lower work roll, and wherein at least one actuator of the set of actuators is vertically adjustable to control bearing load and laterally adjustable such that a position along a width of the upper work roll or the lower work roll is adjustable.

2. The method of claim 1, wherein the first texture has at least one of a size, shape, depth, height or coarseness that is different from at least one of a size, shape, depth, height, or coarseness of the second texture.

3. The method of claim 1, wherein applying the second texture comprises at least partially overlapping the first texture with the second texture on the first surface of the substrate in a single pass of the substrate between the first pair of work rolls and the second pair of work rolls.

4. The method of claim 1, wherein applying the first texture comprises applying the first texture at a first location on the first surface of the substrate and applying the second texture comprises applying the second texture at a second location on the first surface of the substrate that is adjacent to the first location.

5. The method of claim 1, wherein the first work roll pressure and the second work roll pressure applied on the substrate are each below a yield strength of the substrate.

6. The method of claim 1, wherein applying the first texture on the first surface of the substrate comprises applying the first texture to less than or equal to half of a surface area of the first surface of the substrate.

7. The method of claim 1, wherein applying the second texture on the first surface of the substrate comprises applying the second texture to less than or equal to half of a surface area of the first surface of the substrate.

8. The method of claim 1, wherein applying, by the first pair of work rolls, the first texture on the first surface of the substrate comprises applying the first texture on the first surface of the substrate by a first work roll of the first pair of work rolls, and further comprising:

applying a texture different from the first texture on a second surface of the substrate by a second work roll of the first pair of work rolls.

9. The method of claim 1, wherein applying, by the first pair of work rolls, the first texture on the first surface of the substrate or applying, by the second pair of work rolls, the second texture on the first surface causes less than a one percent reduction in the overall thickness of the substrate.

10. The method of claim 1, wherein applying, by the first pair of work rolls, the first texture on the first surface of the substrate or applying, by the second pair of work rolls, the second texture on the first surface causes less than a one percent increase in an overall length of the substrate.

11. The method of claim 1, wherein applying the first work roll pressure on the first surface of the substrate by the first pair of work rolls comprises vertically actuating one work roll of the first pair of work rolls while freezing a vertical position of the other work roll of the first pair of work rolls.

12. A method for applying textures on a substrate, the method comprising:

applying, by a first pair of work rolls, a first texture on a first surface of the substrate, wherein at least one work roll in the first pair of work rolls has the first texture;

and applying, by a second pair of work rolls, a second texture on the first surface of the substrate after applying the first texture, the second texture being different from the first texture and wherein at least one work roll in the second pair of work rolls has the second texture and wherein applying the first texture and the second texture comprises:

applying, by the first pair of work rolls, a first work roll pressure on the first surface of the substrate; and applying, by the second pair of work rolls, a second work roll pressure on the first surface of the substrate, wherein applying the first work roll pressure and the second work roll pressure creates localized areas of plastic deformation on the first surface of the substrate due to a first topography of the first texture and a second topography of the second texture and wherein the first texture and the second texture are applied to the localized areas of the first surface while an overall thickness of the substrate remains substantially constant, wherein each pair of work rolls comprises an upper work roll and a lower work roll, wherein a set of intermediate rolls supports at least one of the upper work roll or the lower work roll, wherein a set of actuators are provided along the set of intermediate rolls and are configured to impart bearing loads on the set of intermediate rolls such that the set of intermediate rolls transfer the loads from the set of actuators to the upper work roll or the lower work roll, wherein at least one actuator of the set of actuators is vertically adjustable to control bearing load and laterally adjustable such that a position along a width of the upper work roll or the lower work roll is adjustable, and wherein the first texture comprises a negatively skewed area on a first location of the first surface of the substrate and the second texture comprises a positively skewed area on a second location of the first surface of the substrate, or wherein the first texture comprises a positively skewed area on the first location of the first surface of the substrate and the second texture comprises a negatively skewed area on the second location of the first surface of the substrate.

13. The method of claim 12, wherein at least one of the positively skewed area or the negatively skewed area has asperities or valleys with an average height or depth between 0 microns and 20 microns.

14. The method of claim 12, wherein the first texture covers less than or equal to half of a surface area of the first surface of the substrate.

15. The method of claim 12, wherein the second texture covers less than or equal to half of a surface area of the first surface of the substrate.

16. The method of claim 12, wherein the first texture covers less than or equal to one-third of a surface area of the first surface of the substrate.

* * * * *